United States Patent [19]

Nelson

[11] Patent Number: 4,762,456

[45] Date of Patent: Aug. 9, 1988

[54] ACCOMMODATIONS TO EXCHANGE CONTAINERS BETWEEN VESSELS

[76] Inventor: Arthur J. Nelson, P.O. Box 3007, Daly City, Calif. 94015-0007

[21] Appl. No.: 873,213

[22] Filed: Jun. 11, 1986

[51] Int. Cl.[4] ..... B66C 23/52

[52] U.S. Cl. ..... 414/138; 212/190; 212/191

[58] Field of Search ..... 212/190, 191, 209; 414/137, 138

[56] References Cited

U.S. PATENT DOCUMENTS

| | | | |
|---|---|---|---|
| 1,309,585 | 7/1919 | Musker | 414/138 |
| 3,828,940 | 8/1974 | Cooper | 212/191 |
| 4,074,818 | 2/1978 | Ray | 212/191 X |
| 4,363,411 | 12/1982 | Blair et al. | 212/191 |
| 4,569,453 | 2/1986 | Oustad | 212/191 |

*Primary Examiner*—Robert J. Spar
*Assistant Examiner*—Janice Krizek

[57] ABSTRACT

A system to transport containers for ports of call by Feeders serving a trade area with each area having an associated terminal located intermittently along a specific route as stops for a fleet of superships (Cellers); there to directly exchange its import cargo containers for export cargo containers borne by a lay-to (LT) left to await a Celler arrival. All terminals are similarly arranged for approach and mooring of vessels and have a floating crane devised for cyclical exchange of containers between vessels with accommodation and control features suiting worldwide utility.

1 Claim, 18 Drawing Sheets

FIG. 13a
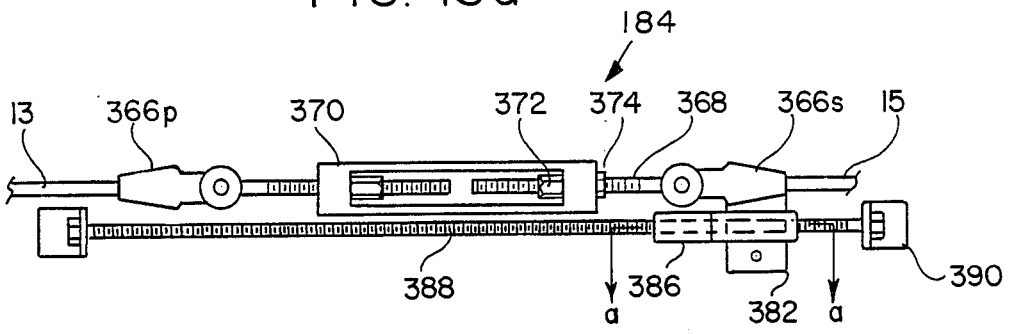
FIG. 13b
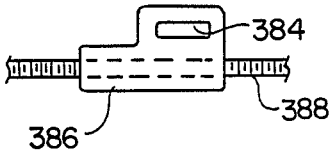
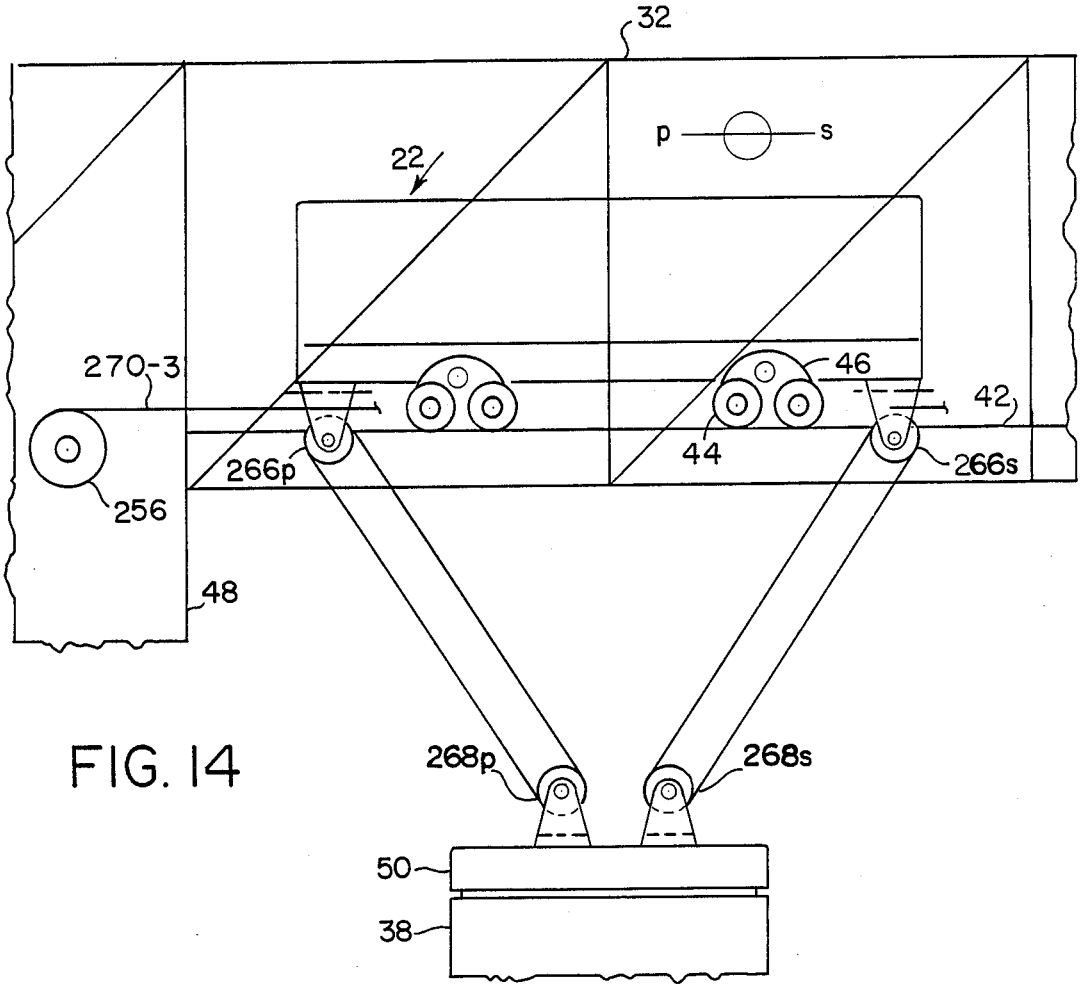
FIG. 14

ACCOMMODATIONS TO EXCHANGE CONTAINERS BETWEEN VESSELS

BACKGROUND OF THE INVENTION

1. Field of Invention:

This invention, about marine transportation of containers embodying the dual performance to haul and handle containers, more specifically applies to the exchange of containers to and from two floating carrier vessels disposed to opposite sides of a floating crane (third vessel). These three floating vessels are in mutual arrangement, being independent of tidal changes at alike offshore terminals, disposed globally. Offshore terminals, with one strategically located adjacent to each of many trade areas, establish a circuitous route for Cellers (subsequently defined) to ply. A preferred site, established in a protective cove, is selected remote to habitation and shipping lanes with indifference to land ruggedness or large bay characteristics. The offshore arrangement of transferring cargo between vessels avoids principal difficulties encountered during a voyage.

Vessels utilized herewith are identified to comply with names used in prior cross-references (subsequently listed). Similar to the concept of mammoth vessels with tanks being called "Tankers," so are super-ships with cells for containers more simply called "Cellers" herein. The term "barge" (as a towed vessel) is replaced by the symbol "LT" to be consistent with the disclosure of said cross-reference. Tugs also are as distinguishable in said cross-references. Tugs in tow of an LT as a combination defines the meaning of a "Feeder" as used herein. Floating cranes have an elevated craneway for a trolley with a hoisting means to exchange containers.

Feeders provide the direct exchange of containers (import and export cargo) at ports. With brief stops at each serviced port of trade area, the fleet size (more LTs than tugs) depends on the time lapse to provide a lay-to LT at an offshore terminal to await a Caller arrival. Feeders are the economical subordinate and supportive system for a fleet of Cellers repeating calls at many alike terminals (avoiding ports).

A Feeder bears export containerized cargo to a terminal and returns to port bearing import containerized cargo having had containers exchanged in the lay-to practice of the LT at a terminal. Cellers exchange certain of its (import) containerized cargo intended for that trade area for all export containerized cargo borne by the awaiting LT. The cyclical means effected between floating vessels for container exchanges to or from either vessel and ramifications therewith is the crux of this invention.

Cellers and Feeders, having specific functions, optimally serve to fulfill said dual performance cooperatively. This invention distinguishes in the mode of container handling as effected at offshore terminals. A facsimile system prescribes cell loading for a terminal by which the crane is disposed to handle containers.

2. Description of the Prior Art:

Standardized containers are uniformly eight feet wide and vary in length from 20 to 40 feet. They are constructed to be stacked one on top of another in a hull honeycombed with cells or on deck of vessels. Containers are lightly constructed to conserve weight and arranged with near corner devices to integrate a stack in regular coincidence. They are treated as fragile and sensitive to handle.

Supercontainerships serve their purpose at sea to transport vast tonnages at high speed, but just as with Tankers, are hard to maneuver particularly repective port consequentials of: comparative shallow water, tortuous passages, two way traffic, congestion and ramifications associated with shoreside facilities, marshalling areas and intermodal services.

Such shoreside consequences and capital intensive sites necessarily dictate supercontainership (noting Cellers are not so involved) be selective in ports of call. Thus some more near port of a trading area may be shunted for rail or truck intermodal means to more long distance haul containers to a port of call. Supercontainerships bear cargo handling gear, distinguishable from Cellers without such gear. Equipment to handle containers, most alike the present invention, are classified as double cantilever, through-leg gantry cranes of several variations. More commonly, these cranes are mounted on shoreside rails paralleling moored vessels for mobility fore and aft of the vessel and have craneways with hoist means to serve a vessel thwartwise.

When floating cranes serve to unload a vessel moored at its side, various supplementary dead-weight means are employed to counteract list tendency of the floating crane, when said hoist means is disposed on the craneway outboard of its hull.

NOVELTY OF THE INVENTION

The present invention distinguishes in having developed a mode of operation providing for: moored engagement of floating vessels, accommodating selective thwartwise travel of a trolley (and consequences therewith), and a controlled fore and aft straight course locating the crane selectively, for the sequential cyclical exchange of containers.

Of prime importance is the provision accommodating elevational change with loading of floating vessels, important in "landing" fragile containers. A corresponding draft accommodation, managed by floating stations is featured. They serve to limit travel by a multiple arranged wire system contributing to the need for said straight course.

SUMMARY

Offshore terminals, accommodating repeating ease of arrival and departure of vessels, provide alike effective equipment for direct exchange of containers between floating vessels disposed to opposite sides of a floating gantry crane. Said floating three vessels are uniformly unaffected by tidal differences in the global range to serve numerous trade areas.

Cooperation exists in the lay-to practice of an LT, having containers of export cargo acquired from many ports in the exchange for import cargo as the traffic for the trade area served. Lts assuming port consequences which hastens Cellers' global voyage.

The LT, as the lay-to first vessel, awaits at a terminal the arrival of the Celler as the second vessel, which is fixedly positioned during its stay at the terminal. Said crane, as disposed between the two vessels, is controlled to a straight course in its tow to selected cell postitions respective the second vessel. The first vessel is then controlled to a straight course to dispose its selected cell with said crane. A craneway with trolley and hoist means extends over a bridge having a second outer bridge portion disposed above the second vessel and a first outer bridge portion disposed above the first vessel. Controlled tow includes means establishing the bridge thwartwise of said straight course. Vessels have several cells abreast in separate holds.

Other features are the antiskew means for the trolley in its tow between the bridge starboard second end and the port first end which houses all power means for the trolley. An antilist means copes with moments developed with the trolley disposed to either said bridge outer portions. A stabilizing means serves to contain the idle crane against storm disruptive tendencies.

LIST OF FIGURES ON 20 PLATES:

FIG. 1 Plan view of three floating vessels at a terminal arranged to exchange containers.

FIG. 2 A starboard side, elevational view of the crane disposed between "distant" primary floating stations serving the crane towing means. To avoid having a cluttered figure, base embedded supporting structure, arranged to slidingly accommodate constant freeboard of station with tidal changes, are shown removed to simplify viewing.

FIG. 3 A plan view diagram of the antiskew means beneath and for the floating crane.

FIG. 4 An end elevational view from forward stations of the aft ends of three floating vessels in moored engagement.

FIG. 5 A starboard side elevational view of the floating crane.

FIG. 6 A plan view diagram of the antiskew means beneath and for the trolley.

FIG. 7 An end elevational diagram of the guy system support of cantilevered bridge ends.

FIG. 8 Elevational arrangement of an LT (first vessel) fixing means to its tow system between distant secondary floating stations.

FIG. 9 A side elevational view looking towards the aft floating station adapted to serve the deeper draft LT.

FIG. 10 A diagram of the equalizer system for the trolley hoist means.

FIG. 11 A starboard side elevational view of the crane disposed between "distant" end floating stations serving (featuring) the crane antiskew means.

FIG. 12 A side elevational view looking forward to the forward floating station serving the floating crane.

FIG. 13*a* Antiskew mechanism of FIG. 12.

FIG. 13*b* View a—a of FIG. 13*a*.

FIG. 14 An aft side elevational view of the trolley with a container.

FIG. 15 A diagram of the trolley hoist mechanism contained in a house disposed to the port end of the bridge.

FIG. 16*a* Stabilizing means serving pendants fixed to bridge outer portions (partial assembly).

FIG. 16*b* An elevational view of a water bed fixed cylindrical structure providing an elevationally adjusted fulcrum for the stabilizing system of FIG. 16*a*.

FIG. 16*c* A plan view of members with the structure of FIG. 16*b*.

FIG. 16*d* A cross section assembly (view a—a of FIG. 16*a*) of the slide means for said fulcrum.

FIG. 16*e* An end sectional view (a—a) of FIG. 16*d*.

FIG. 17 Plan view diagram atop the bridge of the antilist mechanism.

FIG. 18 Elevational side view of the crane with the antilist means.

FIG. 19*a* Clamp detail for the antilist means of FIG. 18.

FIG. 19*b* View a—a of FIG. 19*a* antilist means member.

FIG. 20*a* Antilist engagement means to a floating vessel pipe rail.

FIG. 20*b* Side view in part of FIG. 20*a* showing stays.

FIG. 21 Tension means for trolley towlines.

FIG. 22 Conventional wire rope socket end with eye bolt adjusting means.

FIG. 23 Erected structure having a Selsyn transmitter monitoring tidal changes.

Note: Marine orientation is expressed clockwise as forward (f), starboard (s), aft (a), port (p), and herewith applied as needed in figures to in general consider (f) located with the top of a plate. Part identifying numerals may have above letters as subscripts to aid its location or distinguish positioning of nearby alike members from each other.

DESCRIPTION OF THE PREFERRED EMBODIMENT

Prior art references

Figure 1:
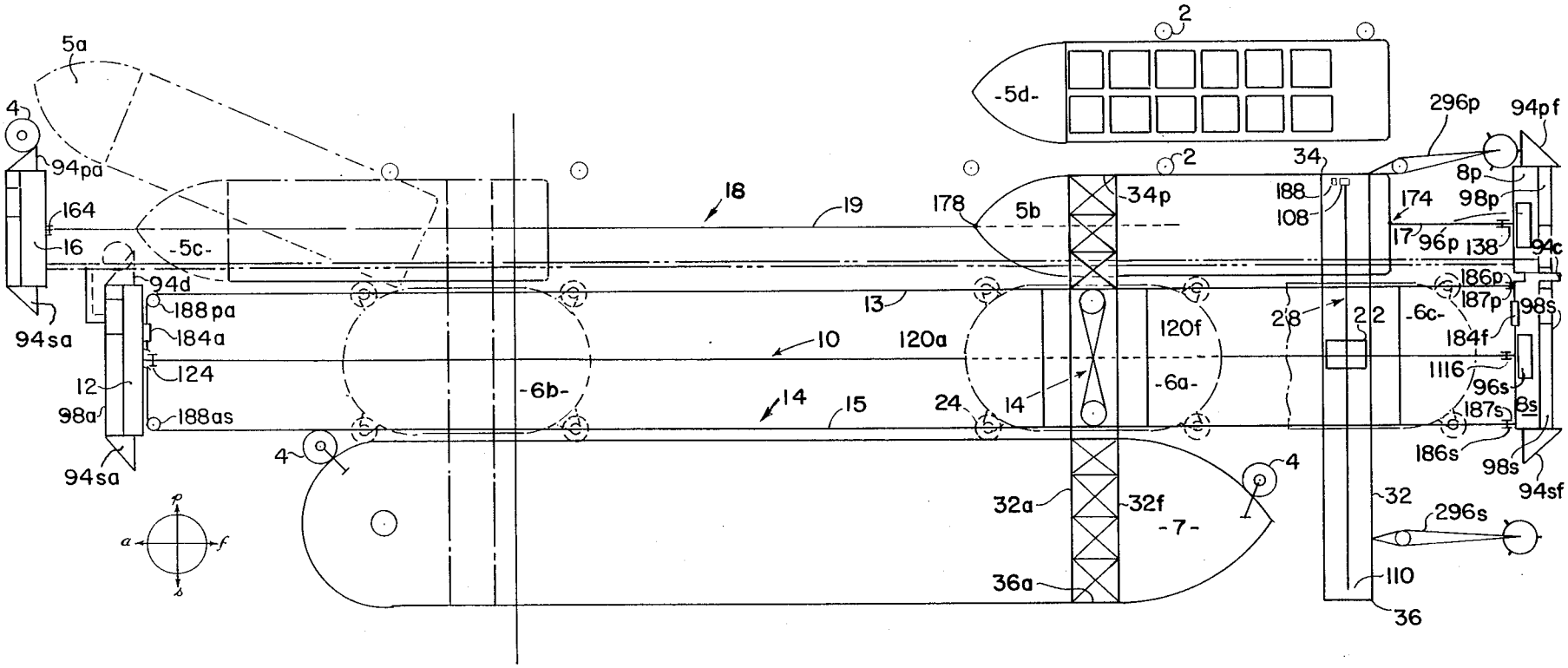

Ref A: U.S. Pat. No. 4,275,677 dated: June 30, 1981.

Ref B: U.S. Pat. No. 4,396,333 dated: Aug. 2, 1983.

Ref C: U.S. Pat. No. 4,553,497 Nov. 19, 1985.

(A) General Arrangement.

(FIG. 1) An offshore terminal is an areal portion of a sheltered cove (distant from the shore and often abetted by a break-water) having been dredged and provided with embedded fenders; establishing a fore and aft directional straight course for floating vessels therewith. Terminals provide the means to effect the direct exchange of containers, involving three floating vessels to obviate therewith the need of marshalling areas and consequentials of ports, which are relegated for servicing by economically operated and effectively maneuvered convenient sized Feeders (defined).

Numerous (some lighted) fenders 2,4 as arranged, present a repeating alike means (among all terminals) for arrival and departure of vessels which themselves have a commonness from production building. A crane 6, as the intermediary one of three floating vessels, effecting container exchanges between two floating carrier vessels (5,7), is seen to be double extended and constrained by wire controlling means (10,14) and fenders to a straight course between a first 8*s* and second 12 floating primary stations. With the crane 6 forward travel directed toward said first floating station 8*s*, the terminal becomes identifiable, as do members therewith (respectively) to have fore (f), aft (a), port (p), and starboard (s) designations.

An LT 5 as the first arrival of floating carrier vessels is seen stern-to forward secondary station 8*p* (having a most effective sternwise maneuverability) seen as LT 5*a*. Consequently, the LT and crane are port-to the other. Assigning the Celler 7 to the most convenient means of approach to and departure from a terminal forward (f) end, establishes the Celler 7 port side to the crane 6 starboard side. Celler 7, most seawardly, is fixed during its stay at the terminal.

LT 5 is constrained by wire towing means 18 and fenders to a straight course between first floating secondary station 8*p* and second aft floating secondary station 16. LT 5*b* depicts the first vessel in awaiting position, whereas LT 5*d* depicts the first vessel position having had containers exchanged and moored to be clear of the berth for the subsequent arrival LT 5*a*. LT 5*c* represents its most aft position.

Fenders 2 are conventional pylons for mooring to or bearing against. Fenders 4 are more substantial structures with floating torus formed bumpers (marketed). Sides of crane 6 have torus formed reel mounted fenders 24,, to space three floating vessels apart as grouped between fenders 2,4. Extreme travel forward of LT 5*b* disposes most forward cells thwartwise of the two carrier vessels, also locates the most forwardly operative position of crane 6*a;* disposing most aft cells thwartwise of the two carrier vessels also locates the most aft position of LT 5*c* and crane 6*b.* Crane 6*c* is in its idle position. Observable, too, is the parallel vessel arrangement advantageously disposing the (largest) second vessel most seawardly, suiting the seabed slope towards deeper water (lessening dredging). Suitably powerful "inflatable" boats serve to maneuver LTs; and, as taxis to and from the nearby settlement, transport labor and some supplies. Said straight course is relied on to maintain a consistent abreast (spaced apart) location between the first and second vessel for a thwartwise automated disposition of the trolley above a selected cell.

The foregoing disclosed a selected arrangement of vessel and structures for reference.

(B) Constructional Features.

Figure 4:
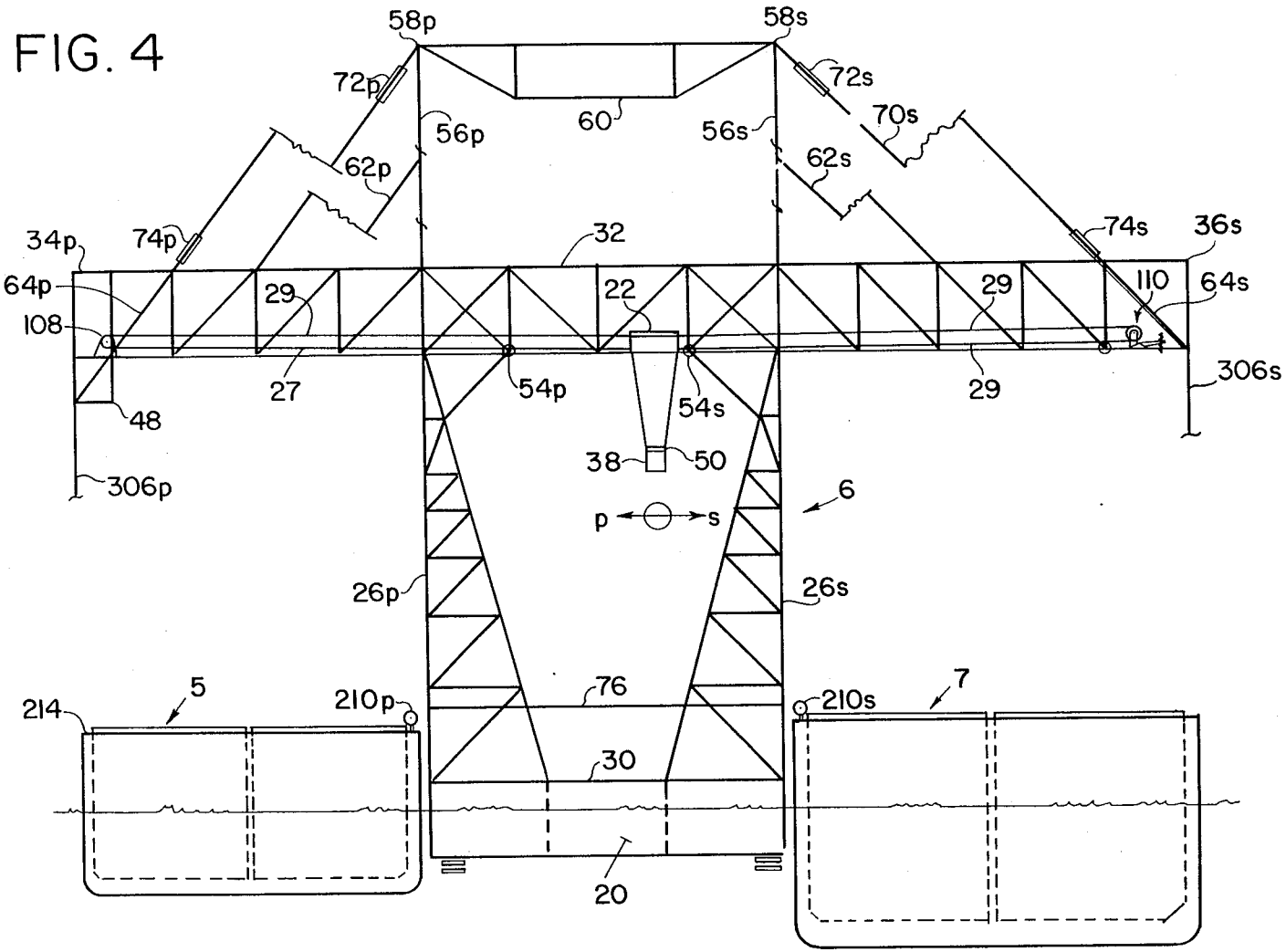
Figures 5, 7:
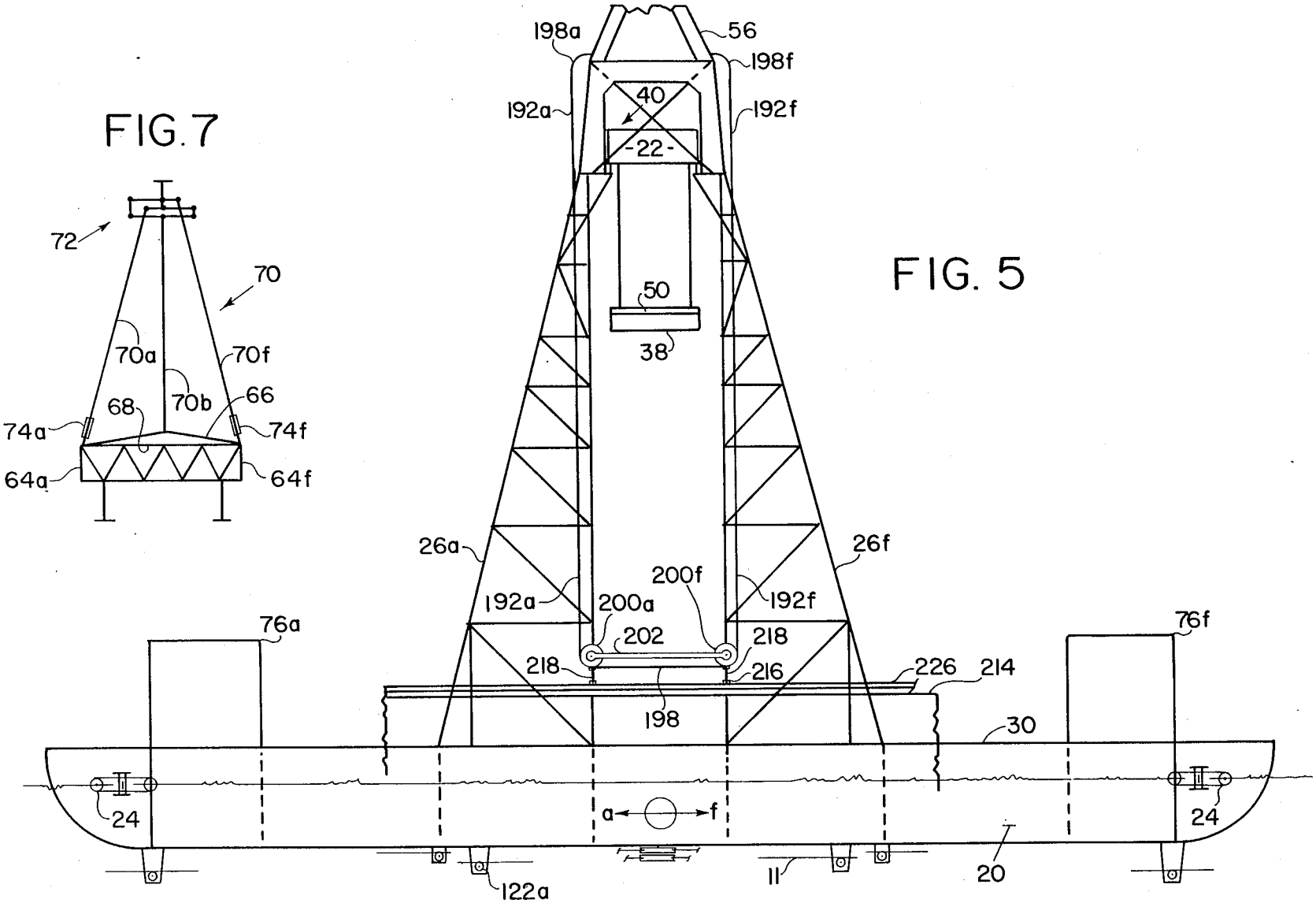

(1) Floating crane 6 (FIG. 4,5) comprising:

(a) hull 20 having longitudinal and thwartwise watertight bulkheads for a selected arrangement of ballast chambers served by a centrally and longitudinally disposed ballast distribution system (conventional with vessels);

(b) displacement of crane 6 is dominantly established by ballast. Consequently, any added load likely to be imposed on the crane insignificantly effects its draft;

(c) (FIG. 4) Towers 26 fixed to deck 30 are erected to elevationally support bridge 32, having a port end 34*p,* identifying a first shorter outer bridge portion above the first smaller vessel (LT5), comprising a first moored engagement; and, having a starboard end 36*s* identifying a second longer outer bridge portion above the larger second vessel (Celler 7), comprising a second moored engagement. The bridge aft side correspondingly is identified as (a) and so the forward side (f);

(d) FIG. 4 shows towers 26 to (thwartwise) sides of hull 20 with container 38 disposed endwise, whereas FIG. 5 shows said towers (thus four towers) disposed to clear (said through-legs) the fore and aft length of container 38. Bridge 32 is representative of a rigid structure of any proper construction to the need to contain a craneway 40, typically of portal arrangement. FIG. 14 shows rails 42 as part of bridge 32 to represent a conventional detail suitable for the application. Rails extend between said ends (34,36) with flanged wheels 44, providing automatic tracking, as pivotal trunk assemblies 46;

(e) house 48 attached to bridge end 34*p* (the shorter bridge first outer portion) contains motive power means and mechanisms pertaining a trolley travel and hoist (lift) means. Aside from the weight of spreader 50 (the engagement means arranged to contend with container 38 length variation), the aggregate weight on rails 42 approximates 48 l.t. (long tons).

House 48 and its contents balance the weight difference of said outer bridge portions. Thus, the moment with the trolley 22 outboard is lessened to ease provisions for antilist of the crane;

(f) hinge means 54 (incidental to the application) reveal how the bridge is sectioned at assembly for the outer bridge portions to suspend erect as folded between towers 26 and clear of the hull sides in transit from their building to a site. The significance for ballast is apparent;

(g) (FIG. 4) a pair of superimposed "A" frames 56 above said bridge, as a braced structure, establishes an apex 58 with a connecting simple truss 60 therebetween. Guy wire members 62 also serve to lessen the slenderness ratio of legs of the "A" frame 56;

(FIG. 7) the outboard ends 34,36 of the bridge (truss structure 32) incorporates legs 64 for a strongback 66 and its interconnecting beam 68 which are set to the angle established from bridge ends 34,36 to said apex 58. An equalizing guy system 70 (FIG. 7) comprises 3 wires 70 *a,b,c* with socketed ends for an upper reach to levers of an equalizing mechanism 72 (subsequently described). The middle wire 70b extends down for central connection to the strongback 66. The outer two wires 70*a,c* extend down to the bridge side legs 64 with the three socketed ends connected to turnbuckles 74 set with the strongback. The guy system 70 establishes distributed and equal side support of the bridge to offset twist in the bridge structure; and (h) two similar structures 76 above deck 30 near to both ends of hull 20, providing: at forward end 76*f* housing, quarters, offices and clean store needs of the crew (in rotating employment from a neighboring port of call), while the aft end 76*a* houses the power plant, shop facilities and replacement parts to service Cellers 7, and LT 5. (Tugs are serviced in suitable ports.) Central end said chambers forward contain a replaceable supply of fresh water conveyed thereto bt LTs 5 for need of the crew on both the crane 6 and Celler 7. Central end said chambers aft contain a replaceable supply of fuel oil conveyed thereto by those LTs serving ports exporting fuel. Ends of hull 20 contain means of fluid transfer. Cellers convey stores between terminals as needed.

2. Floating stations 8, 12, 16 (FIG. 1, 2, 8, 9, 11, 12)

(a) stations are constructed of fiberglass reinforced plastic (F.R.P.) to conventional practice. A station measurement fore and aft (narrow) may be limited to that required of station 8 having mechanism for crane tow means 10, with pendant wire 9,11 of its towline disposed outward of and established clear of station 8 by sheave and drums employed therewith;

(b) immersed depth (draft) of primary stations (8*s*,12) are commensurate with that of crane 6 which has insignificant draft changes; thus ballasting is manually monitored for stations (8*s*,12). In order to alter the depth (draft) of stations (8*p*,16) to suite LT 5 draft changes, means of Ref. B is adapted to monitor ballasting of stations (8*p*,16), relying on conventional ballast distribution means. Incorporated, is a pair of main conduits 78 FIG. 2 (as a manifold means for suitable branching), extending (ballast) water pipes and electrical conductors embedded in the sea floor 80, between stations with looped members 82 effecting the connection to vertically changed position of stations. Isolated end chambers 84 FIG. 9 contain equilibrium ballast means to establish the station level; and, (c) all port (p) and starboard (s) station ends, bear alike upper and lower flanged wheel means 90, to engage with (channel type) rails 92 forming the erect member of a tower structure 94, fixed to sea floor 80 (best seen in FIG. 12). The plan views in FIGS. 1, 3 show a triangular formed base for structure 94, reflecting the base construction of one of four legs of tower system 26. Stations are thus stayed to rise and fall with the tide; and, are represented to be supported by structure 94 with occurence of wheels 90 therefor.

Stations 8*p,s* have an intermediate single leg structure 94*c* which depends upon an (eye beam) rail 92*b* for wheel 90 of both stations to engage with (FIG. 1). A platform 98 extends between end structures 94 for station 12 to support house 100 containing mechanisms including an auxiliary diesel generator set 108 and ballast water motor pump 104. Remotely located house 100 to said quarters aboard the crane 6 minimizes acoustical distraction. (Generator set 108 is the source of energy for port lights and domestic need with the crane 6 idle.)

(c) The following disclosure of operational means reveals essential elements in combination to effect numerous arbitrary longitudinal positions, for repeating thwartwise cyclical exchange of containers between said first and second floating vessels. The arrangement to select cells for export containerized cargo (furnished by a trade area) and import containerized cargo for a trade area is a computerized process to cyclically exchange containers between vessels.

(1) Members therewith are identified by numerals and with subscript distinguishing alikeness of duplicating parts. A thorough disclosure for one of two or more alike systems is deemed inclusive of all as clarified for minor changes not effecting the principle established. Disclosures for the trolley tow and antiskew systems, being above water, are the simplest, serving for the complete disclosure.

There are three similar towing systems: a first towing system 10 for crane 6, a second towing system 18 for LT 5, both in part depending on immersed wires beneath its vessel; and, differing in being entirely above water, a third towing system 28 for trolley 22.

Figure 21:
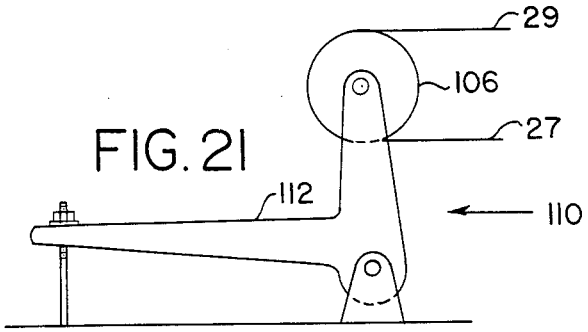

(a) FIG. 4,6 towing means 28 for the thwartwise controlled movement of trolley 22 between bridge ends 34,36 relies on sheave 106 with adjustable means 110 (FIG. 21) established at bridge end 36 to loop wire 27,29 with the lower leg fixed 120 (FIG. 22) to trolley starboard side and the upper leg extended through the trolley to be the upper leg wrapped around double drum 108 which is powered by a conventional gear motor 188. Said gear motor and drum mechanism at bridge end 34, effecting the two-directional travel of trolley 22, provides a lower wire 27 for connection 120 to the port end of trolley 22. Details of tension adjusting means 110 (FIG. 21) are conventional arrangements of a padeye means to pivot as bracket 112 to which sheave 106 is mounted. A bracket arm extends to a screw means understood serving to move sheave 106 directionally as required.

(FIG. 16*c*) a drum may be made "dual" by a central ring fixed to the drum periphery to which wires are connected for wrapping, with one wire paid-off from the top and the other wire (tensioned) hauled-in with turning of the drum, for a common directional disposition as wires loop to a sheave. Rotational powering of drums provides for the fore or aft tow of trolley 22.

Figure 2:
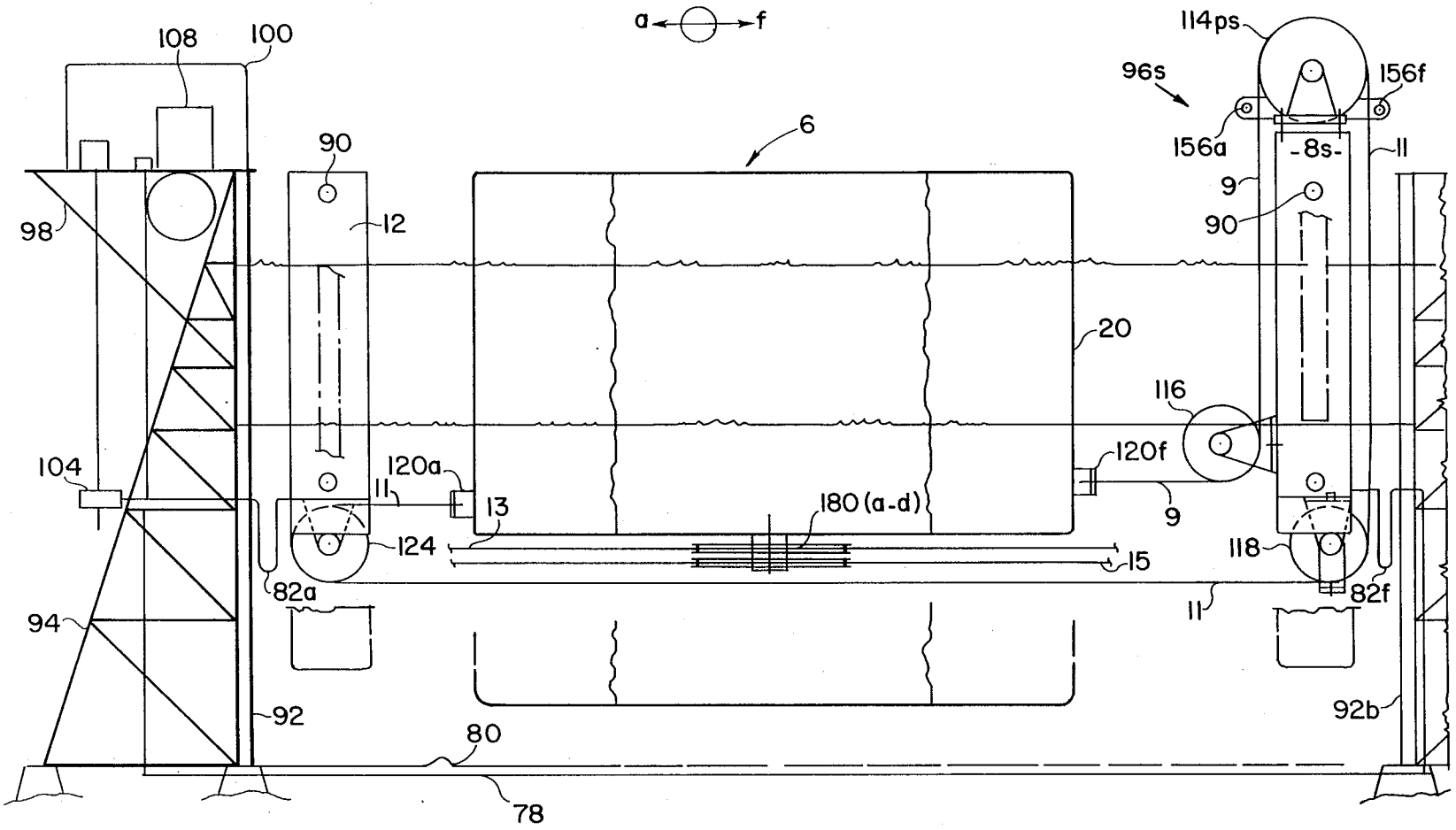
Figure 3:
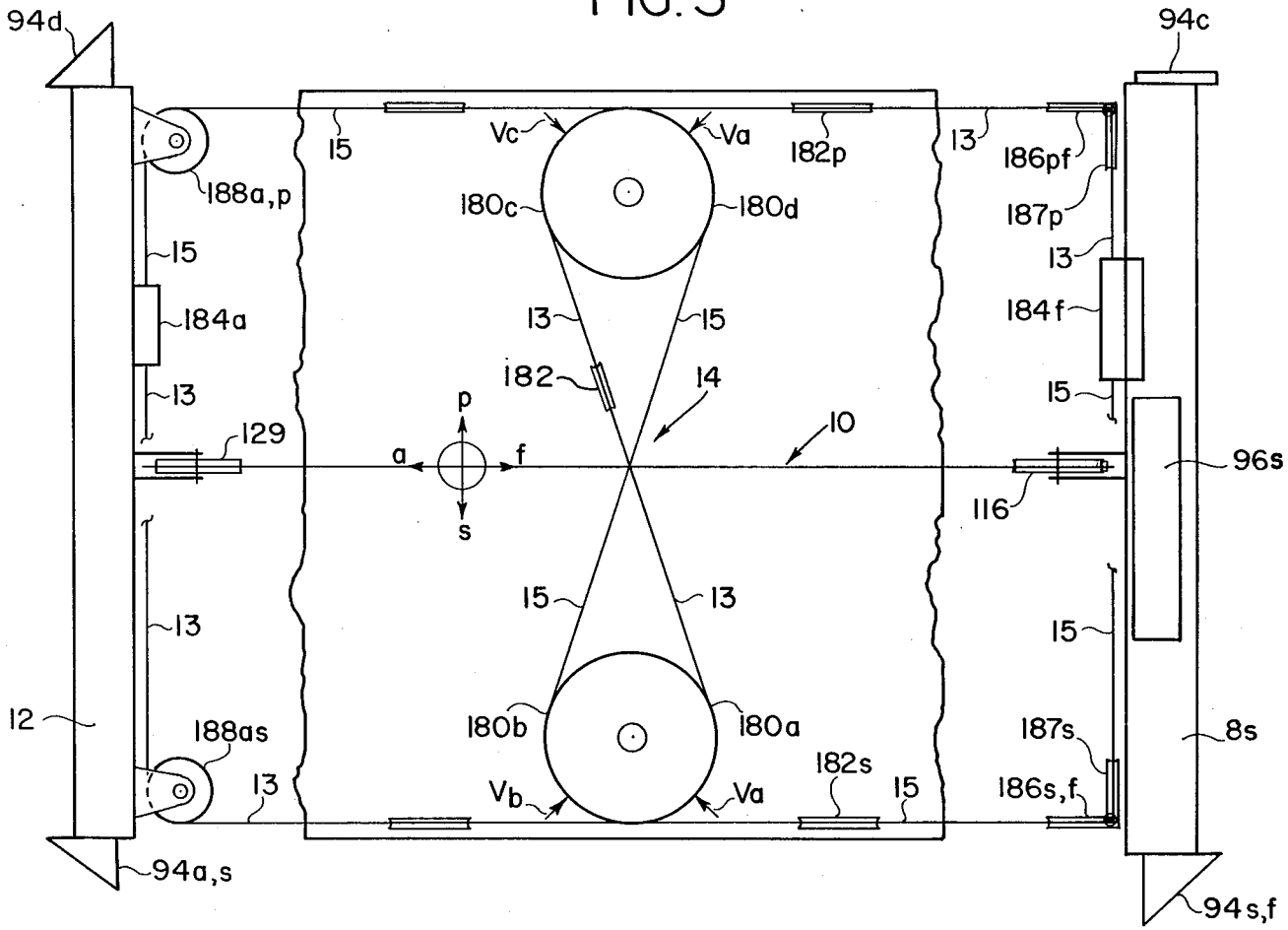
Figure 12:
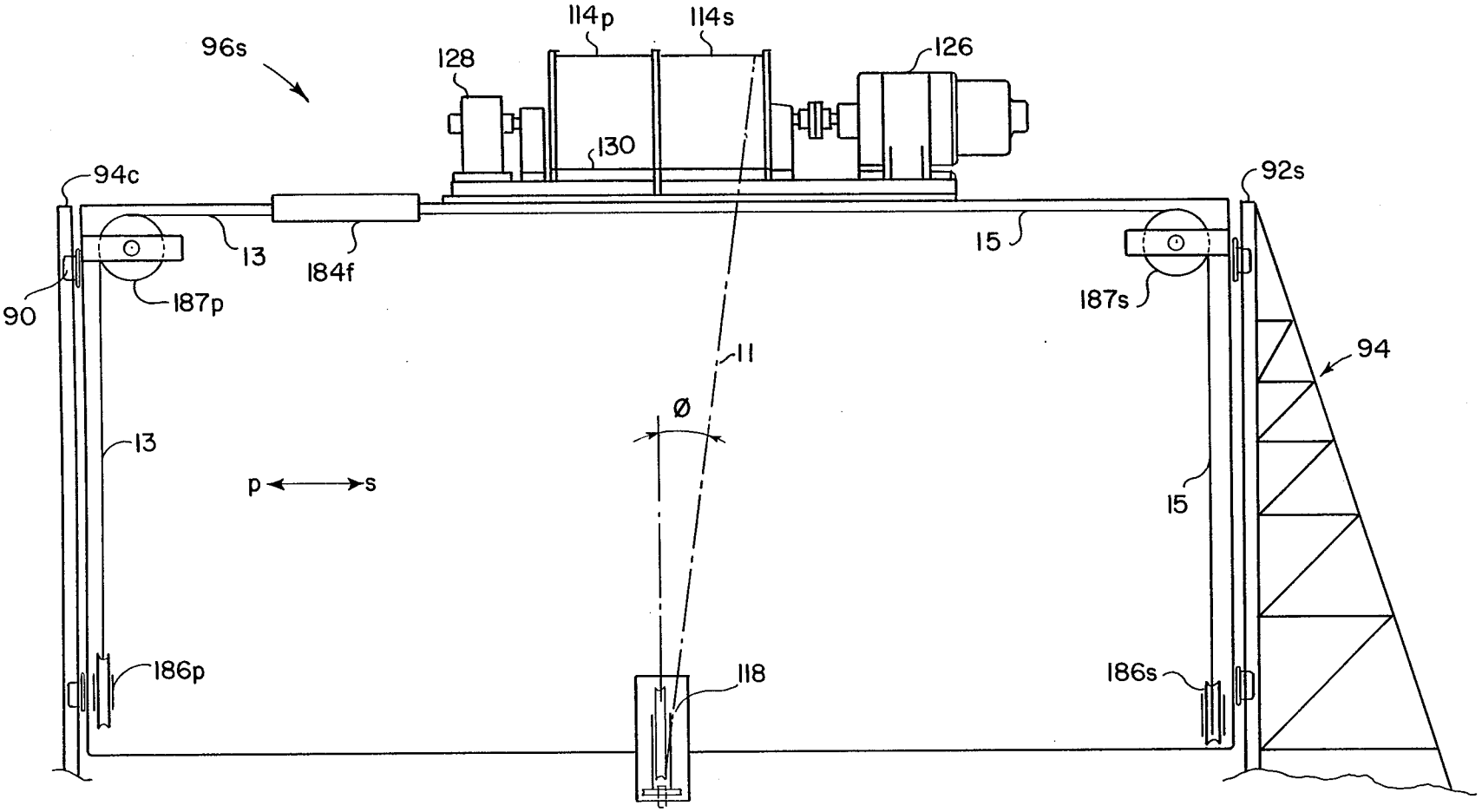

(b) Crane towing system 10 (FIGS. 1, 2, 12).

(FIGS. 1, 2) crane 6 towing system 10 comrises wires 9, 11, as powered by crane tow mechanism 96*s*, and reeved by an arrangement of sheaves mounted to stations 8*s*,12, with wires immersed in part beneath crane 6. FIG. 2 discloses the side view of mechanism 96*s* atop station 8*s*, with double drum 114*ps* sized with a tread diameter for wire 9 off the drum to suspend clear of station 8*s*, to reeve with swivel sheave 116 as a fairlead of wire 9 to connect by means 120*f* to forward end of crane 6; and, drum 114*ps* therewith, accommodating suspending wire 11 clear of station 8*s* for reeving with swivel sheave 118, to dispose wire 11 beneath hull 20 as supported by sheaves 122*a* fixed to the bottom of hull 20 (FIG. 5), for reach to sheave 124 to effect a loop of wire 11 to connect at 120*a* with the aft end of hull 20.

FIG. 12 discloses the baseplate mounted assembly 96*s*, comprised of: double drums 114*p,s* as coupled to gear motor 126 and brake means 128. Seen also is the fleet angle $\phi$ resulting with the drum face sized to accommodate turns of wires, with inadequate wire 11 lead between swivel sheave 118 and drum 114s. Wire rope layering to drums needed to stow the length of wire extended to tow the crane is accommodated by wire coiling, quick reversing mechanism 130 (commonly marketed product) providing uniform layering of wires.

Structural towers 94 are understood to position stations and shown clear (FIG. 2, 8, 9, 11, 12), for uncluttered particulars of the towing system 10. Appurtenances proper to a station may be omitted from (not drawn in, then immaterial to) certain figures addressed to a particular element. Tension adjusting means 120 (FIG. 22) connecting wires to ends of the crane is seen dfisposed below water level. These occasional adjustments are manually attended to by members of the crew provided with suitable apparel. Means 120 is extensively used in this application.

Figure 8:
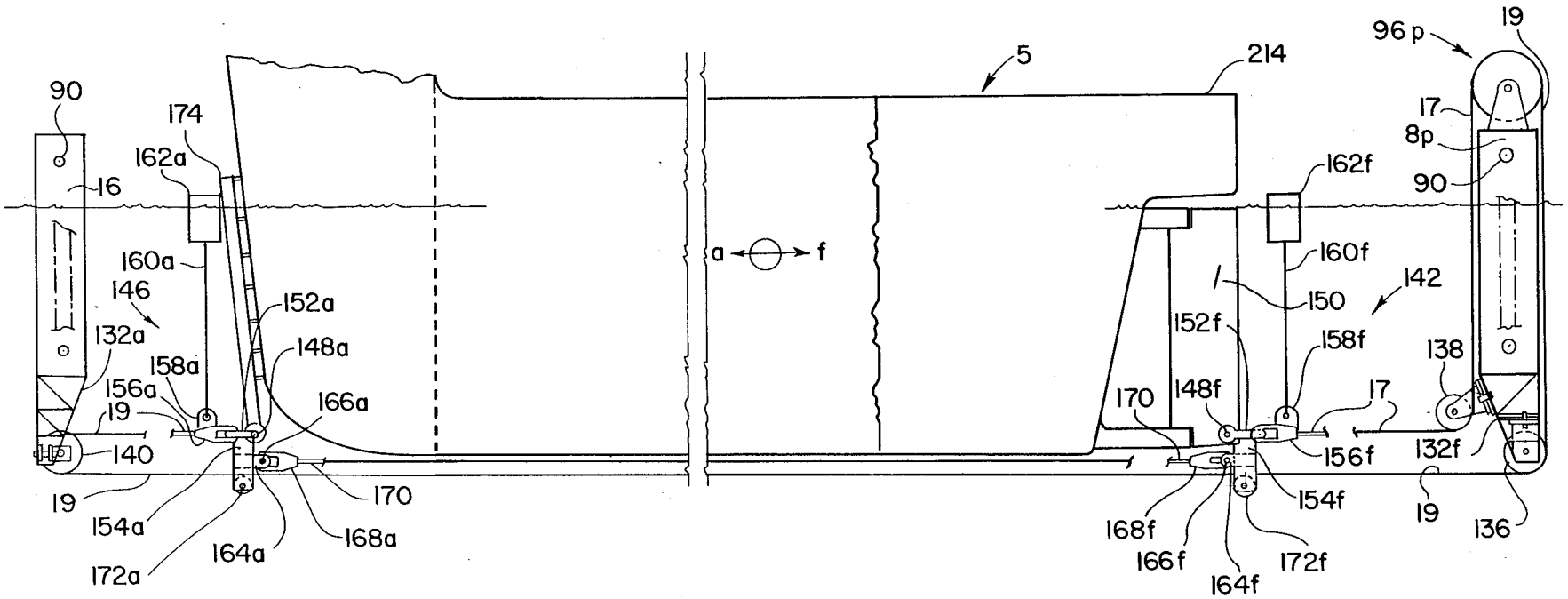
Figure 9:
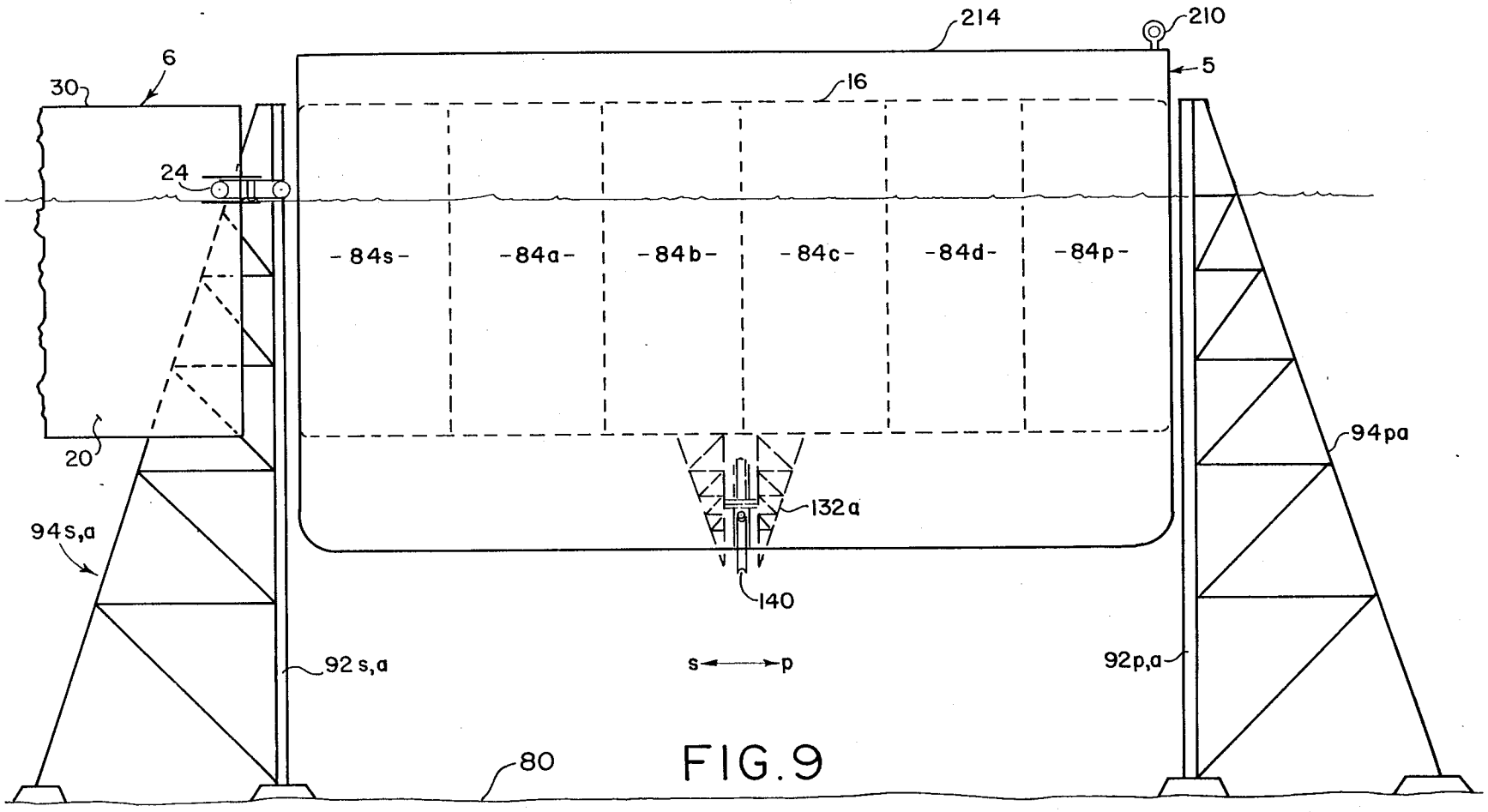
Figure 11:
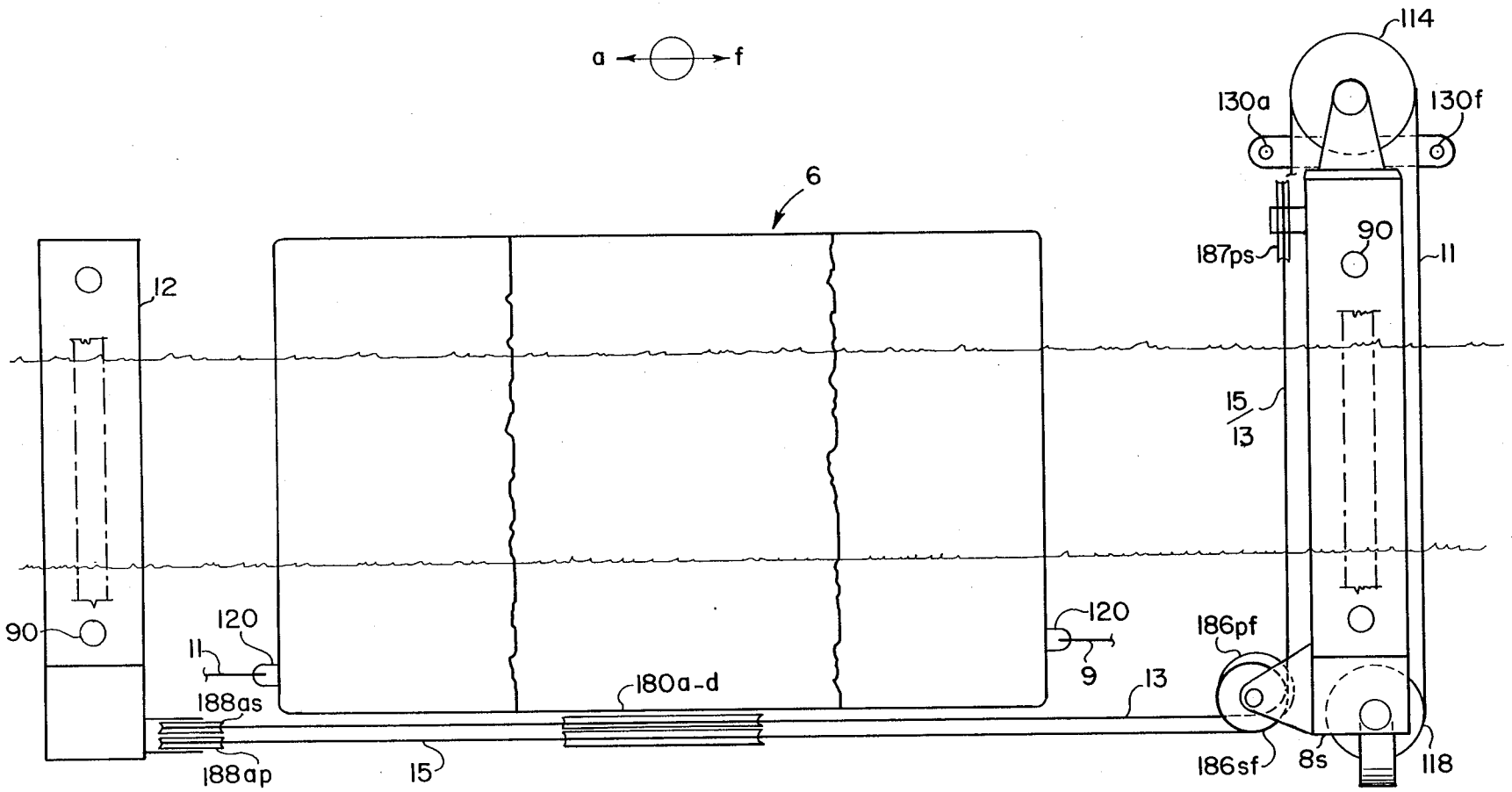

(c) LT towing system 18 (FIGS. 1, 8, 9).

Tow of an LT 5 distinguishes from the tow of crane 6 in: the LT 5 has a deeper hull than crane 6; an LT 5 draft changes with loading versus the constant draft of crane 6; and, the temporary integration of an LT 5 to towing system 18 versus the continuous engagement of the crane 6 to its towing means;

(1) all stations 8*s,p* 12,16 are taken dimensionally the same, but secondary stations 8*p* and 16 now have a framework 132 to lower its swivel sheaves 136,138 with station 8*p*, and sheave 140 with station 16 for fairleads of wires 17,19 off them to suit the increased depth of LT 5 hull;

(2) as noted for hull 20, having ballast chambers, so do stations. Isolated end chambers 84*p,s* have permanently contained ballast to establish a level trim of the station seen in FIG. 9. Intermediate baffles 84 *a–d* avoid surging while maintaining a uniform ballast water level during ballast changes. Station draft changes are effected to maintain a fixed spacing of wire 19 beneath an LT 5. Provisions covered by Ref 2, serve as adapted therefrom, to monitor freeboard relationship, thus controlling the station changed draft to suit the LT 5 change. Ballast water transfer involves use of pump 104 as associated with embedded conduit 78;

(3) particulars of FIG. 8, providing means to effect the engagement of an LT 5 with the towing system 18, are deferred pending essentially a repeating disclosure for the crane towing means, comprising:

(4) LT 5 towing system 18 (FIG. 1, 8) comprises wires 17,19 as powered by LT towing mechanism 96*p* and reeved by an arrangement of sheaves mounted to stations 8*p*,16 with wires immersed in part beneath the LT 5. FIG. 9 discloses the end view of station 8*p*, understood to have an LT 5 towing mechanism 96*p* (FIG. 1), as displayed in FIG. 12, its equivalent. Wire 19 is indicated extending down the forward side portion of a dual drum again at a fleet angle $\phi$ to depend upon swivel sheave 136 as explained for wire 11 of FIG. 12. Companion wire 17 leading from the aft side of the dual drum engages with swivel sheave 138 for lead to leverage stern mechanism 142 (FIG. 8) associated with the LT 5 rudder.

FIG. 8 includes the aft station 16 without a towing mechanism to include a sheave 140 lowermost disposed by framework 132*a*. Sheave 140 effects the aft station 16 loop of wire 19 extended from station 8*p*. The said loop of wire 19 provides for its extension forward to engage with leverage mechanism 146 of FIG. 8.

(2) There are two similar antiskew wire systems: a first antiskew system 14 for crane 6 disposed in part immersed beneath the crane; and a second antiskew system 52 for trolley 22 disposed entirely above water, a redundancy.

Figure 6:
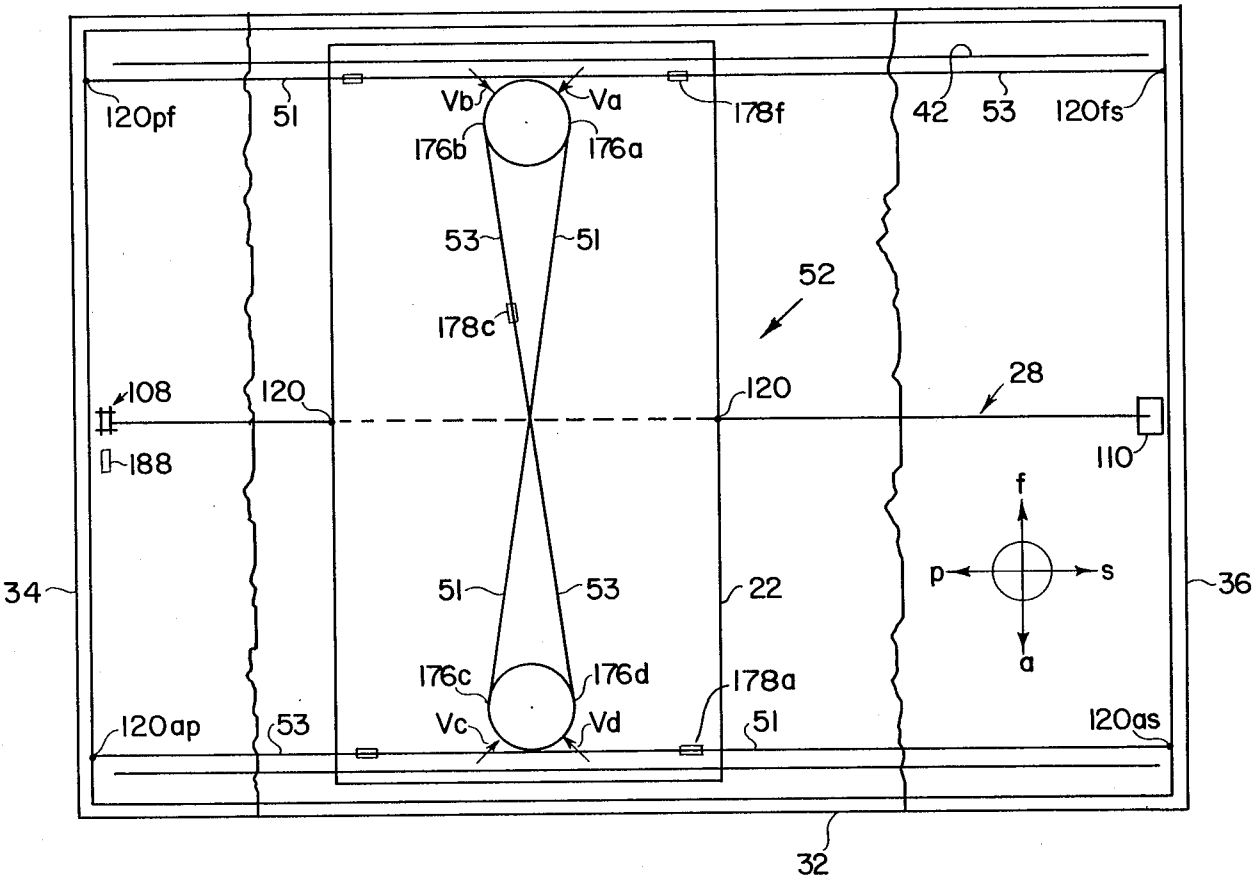

An antiskew system depends on statically fixed tensioned wires which are selected for maximum flexibility and made of stainless steel. Sheave groove diameters, effecting a crossover of wires arranged to extend parallel and spaced apart, exceed manufacturer's recommendations for stiffer wires, to ease said crossover effected by the moving body with sheaves in engagement with the wires. Wire terminal arrangement 120 (FIG. 22) are conventional socket end 366 for pin engagement with conventional eye bolts 368;

(a) FIG. 6, 14 trolley 22 antiskew system 52 comprises, fixed wires 51,53 as reeved around an arrangement of sheaves, and augments flanged wheels 44 bearing on rails 42, for repeating traverse of the trolley between bridge extremities. At installation, trolley 22 is squared to rails 42 with wheels 44 bearing against rail stops adjacent to a bridge extremity;

(1) said sheave arrangement comprising: a pair of double sheaves 176 mounted (sheave grooves horizontal, axis vertical) to the bottom of, and midway the length of trolley 22 and spaced apart fore (f) and aft (a) approximating the span between rails 42, designating bridge side (f) having sheaves 176 a, b and side (a) having sheaves 176 *c,d;* lesser diameter guide sheaves 178 are mounted to corners of the trolley 22 having horizontal axes and positioned to center their grooves with those of sheaves 176;

(2) parallel disposed wires 51,53 have terminal ends 120 providing screw adjusting means to taut wires at bridge ends 34,36. As crossed-over in "S" fashion by said sheaves 176, wires 51,53 appear as extensions of the other. Said arrangement results in wire 51 with terminals 120 *p,f* and 120 *a,f* being in engagement with sheaves 176*a,c* and wire 53 with terminals 120 *a,p* and 120*f,s* being in engagement with sheaves 176 *d,b*. The horizontal plane of wire 53 is above that of wire 51;

(3) peripheries of sheaves 176 *a–d* are said spanned apart to be tangent to and contained between said taut parallel wires. The "S" pattern of a wire, having extended legs parallel and spaced apart, develops with two sheaves each to the opposite sides of the kwire (conceived straight), e.g. sheaves 176 *a,c* are opposite sides of wire 51. Consequently, tension in the wire exerts a force against both its sheaves, disclosed as vectors V*a–d*. The vectors (with a wire) are parallel and directed oppositely to the other. Conventionally, these vectors have components parallel with the trolley travel:

(4) trolley directional and straight travel is unaffected with the two wires serving simultaneously, experiencing minor bearing frictional drag, with one wire automatically made active to oppose impediments to trolley travel.

Assume an obstruction occurs near to the trolley aft side (a), opposing a port-to travel. If sufficiently most resistant with towing persistent, the component of vector by wire 51 is negated (wire 51 made passive). The consequential skew of the trolley side (f), to advance more than side (a), establishes a tension in wire 53 by sheave 176*b*, with said tension transmitting a component of vector force exerted to sheave 176*d*, directed against said obstruction, The statically and tension fixed wires, in arrangement with sheaves disclosed, provides an antiskew means;

(5) sheaves 178 provide tangential bearing support of wires, sheaves 176 provide little more than a 90° wire departure. Sheaves 178*a,f* serve to eliminate wire sag immediate to sheave 176, to negate a fleet angle therewith. Sheave 178*c* eliminates chafing between wires 51, 53. As the trolley is towed by wires 27,29, connected to the trolley from midway between rails, the trolley cannot be drawn along more to one side (f) or (a) than the other because of the oppositely arranged and crossover wires;

(b) Crane antiskew means 14 (FIGS. 1, 3, 11, 12, 13, 22).

(FIG. 3) crane 6 antiskew system 14 comprises wires 13,15 as reeved around an arrangement of sheaves and extended between primary stations 8*s*,12, in part submerged below the crane, to provide a thwartwise disposition of bridge 32 respective the straight course tow of the crane;

(1) said sheave arrangement comprising: a pair of double sheaves 180, mounted with grooves horizontal to the bottom of and midway the length of crane 6, and spaced apart approximately the crane width; designating sheaves 180*ab* adjacent to crane side (s), and sheaves 180*c,d* adjacent to crane side (p). Lesser diameter guide sheaves 182 are mounted to the bottom of the crane for their grooves to effect wire tangencies avoiding wire fleet angles ($\phi$) with sheaves 180;

(2) parallel disposed wires 13,15 have thier one ends, joined by composite turnbuckle 184*a* (FIG. 13*a*), below water level at aft station 12 and their other wire ends joined by composite turnbuckle 184*f*, atop station 8*s*. An immersed wire arrangement is effected by sheaves 188 with vertical axis connected to station 12 and by sheaves 186 with horizontal axis connected to station 8*s* for wires to be directed upwardly above water.

In that arrangement, wire 13 has been reeved by sheave 186*p,f* for a horizontal leg to reeve (slightly more than 90°) with sheave 180*c* to extend its leg tangent with sheave 180*a* for a leg to extend to sheave 188*a,s* for fairlead to composite turnbuckle 184*a*. In alike manner wire 15 from sheave 186*s,f* engages with sheaves 180*b,d* and 188*a,p* for fair lead to composite turnbuckle 184*a*. Said wire arrangements have been to each one's horizontal plane, with wire 15 below wire 13 observed in FIG. 11; and, (3) (FIG. 12) sheaves 187 are seen mounted to station 8*s* for fairlead of wire legs toward composite turnbuckle 184*f* detailed in FIG. 13.

(4) crane directional and straight travel is unaffected with the two wires serving simultaneously experiencing minor bearing frictional drag, with one wire automatically made active to oppose impediments to crane travel.

Assume an obstruction occurs near to the crane starboard side (s), opposing an aft travel. If sufficiently most resistant with towing persistent, the component of vector by wire 15 is negated (wire 15 made passive). The consequential skew of the crane side (p) to advance more than side (s) establishes a tension in wire 13 by sheave 180*c* with said tension transmitting a component of vector force exerted to sheave 180*a*, directed against said obstruction. The statically and tension fixed wires in arrangement with sheaves disclosed provides an antiskew means;

(5) The discussion for use of sheaves 182*p,s,c* is understood a repeat of sheaves 178*a,f,c* in (5) for the trolley antiskew means.

(3) LT 5 connection with system 18.

(a) FIG. 8, Stern mounting connection 142. With LT 5 stern towards the terminal forward secondary station 8*p*, wire rope lead 17 is directed to a hole 148 drilled in rudder 150 to effect connection 142. Chain shackle 152 pin connected to hole 148*f* has two lengthened bars 154*f* welded parallel with and to the legs of said shackle 152*f*. Closed socket 156 (wire 17 terminal fitting and engaged with shackle 152*f*) has a padeye 158*f* welded to it for connection of a pendant 160*f* extended from a float 162*f*. Pads 164*f*, welded to bars 154*f* (said two), provide pin connection means 166 for mounting conventional closed socketed end fitting 168*f* or tie-wire 170*f* to a prescribed measurement from bars 172*f* disposed vertically. The lower end of bars provide for the mounting of sheave support means of wire 19 extending between secondary stations 8*p*, 16;

(b) FIG. 8, Prow mounting connection 146.

Stem post 174, a heavy round bar, bracket-mounted to extend from the LT 5 prow, has its lower end forged for pin mounting chain shackle 152*a*. (Repeating discussion a) shackle 152*a* has two lengthened bars 154*a* welded parallel with and to the legs of shackle 152*a*. Closed socket 156*a* (wire 19 terminal fitting and engaged with shackle 152*a*) has a padeye 158*a* welded to it for connection of a pendant 160*a* extended from a second float 162*a*. Pads 164*a*, welded to bars 154*a* (said two), provide pin means 166*a* for mounting closed socketed other end 168*a* fitting of tie-wire 170 to a prescribed measurement with both bars 172 disposed vertically. The lower end of bars 154*a* provide for mounting of a second sheave 172*a*;

(c) Combined assemblies FIG. 8.

With legs 154 both said vertical, thus parallel together, wire 170, said pin connected 166*a,f*, is taut to assume a static essentially passive presence during the LT 5 tow process involving wires 17,19. To effect trade-off of the LT 5 from the towing system 18, a diver with suitable apparel applies sufficient force means (optionally muscular) against bars 154*a*, with said force directed toward station 16, and with an opposing obstruction against bars 154*f*, utilizing pin means 166*a* as a fulcrum. A retaining means is employed to sustain said force. Now the pin means with hole 148*a* may be removed. As said retaining means is released, tension in wire 19 separates shackle 152*a* from stem 174, for the assembly 146 to assume a phantom open position. The bond remains between wire 19 and 170, (connected by the weldment of shackle 152*a*, bars 154*a*, padeye 164*a* and pin 148*a* reset to shackle 152*a*);

(d) a resulting slack with assembly 146 open enables pin means to be removed, which connects shackle 152*f* to the hole 148*f* in the rudder 150. The disengaged shackle 152*f* allows assembly 142 to take the position of assembly 146 as freed. Wires 17,19 with fittings remain connected together by tie-wire 170. LT 5*b* is moved to position LT 5*d* by said inflatable power boat effecting said trade-off of LTs;

(e) to engage an LT 5 to the towing system 18.

Shackle 152*f* is first engaged to rudder hole 148*f*. Thereupon, again utilizing said obstructing and retaining means, shackle 152*a* is pin means engaged to the stem part 174.

During these maneuvers to said engage and disengage, the pendants 160 from said floats 162 provide weight support of members involved. Said means for obstruction and retaining forces may be arrangements of embedments with wired fittings for the repeating spotted position of the LT 5.

Figure 17:
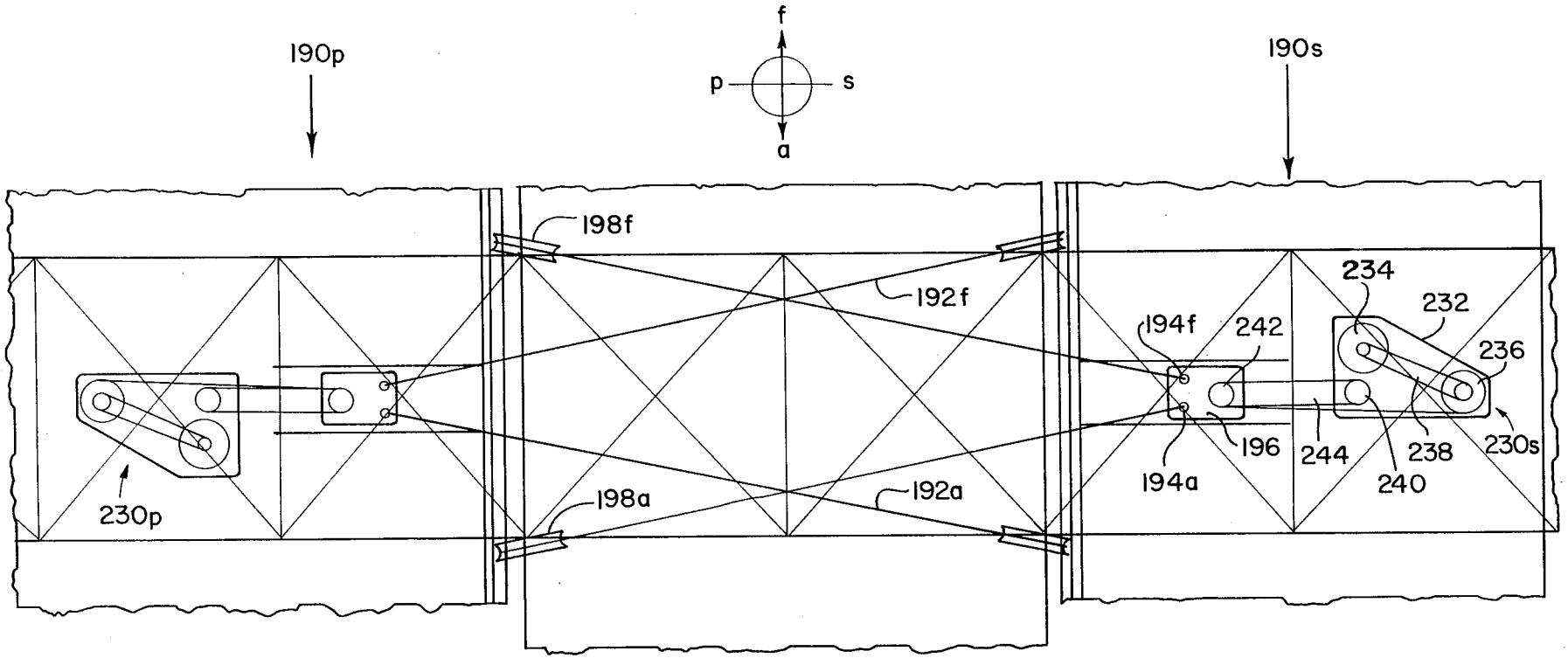

(4) Antilist system by composite assemblies 190. FIG. 17

This compensating means serves the intermediary floating vessel (crane 6), with movement of trolley 22 on bridge 32 through the intermediate bridge portion between column assemblies (tower 26), to or from a first (shorter, with end 34*p*) and second (longer, with end 36) counter end bridge portions, when the trolley is outboard of sides of hull 20.

Exchange of containers by trolley movement, between a first floating smaller vessel (LT 5) beneath the first outer end bridge portion comprising a first moored engagement, and a second larger floating vessel (Celler 7) beneath the second outer end bridge portion comprising a second moored engagement, relies on two composite assemblies 190 with a vertical portion of each having adjustably connected (lift) hooks (FIG. 20*a*) to engage with a pipe rail fixed to the deck of vessels.

A recall of the towing means for the straight course controlled tow of vessels comprises: the floating crane 6 disposition of its bridge 32 respective a selected cell of the fixed position second floating vessel (Celler 7), and the subsequent disposition of the first floating vessel (LT 5) for its selected cell to be thwartwise of the selected cell of the second vessel, whereby the bridge of the crane is aligned gned above said cells, for a trolley travel over the bridge to exchange containers to and from both vessels, a two-way cyclical exchange of containers.

This mode of exchanging containers with repeating movements, in an apparent irregular but arbitrary pattern, exacts a mooring engagement in contention with individual vessel draft changes from changes in loading, thwartwise trolley travel, and fore and aft travel of floating vessels.

Figure 19B:
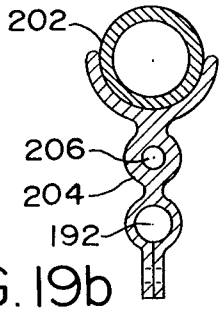
Figure 19A:
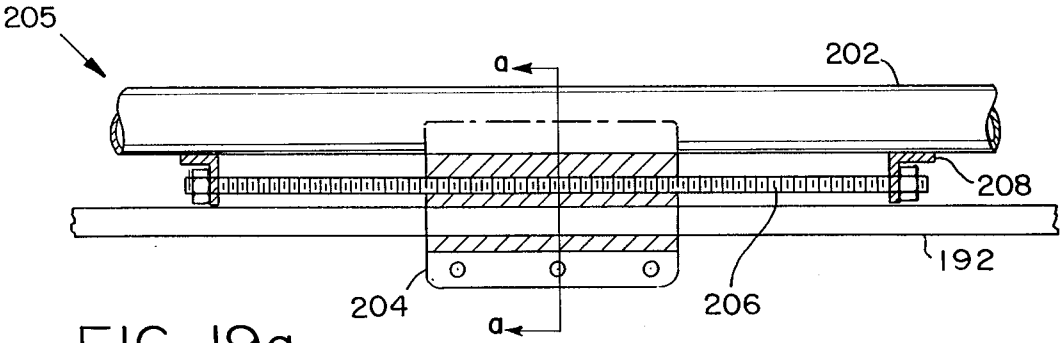
Figure 20A:
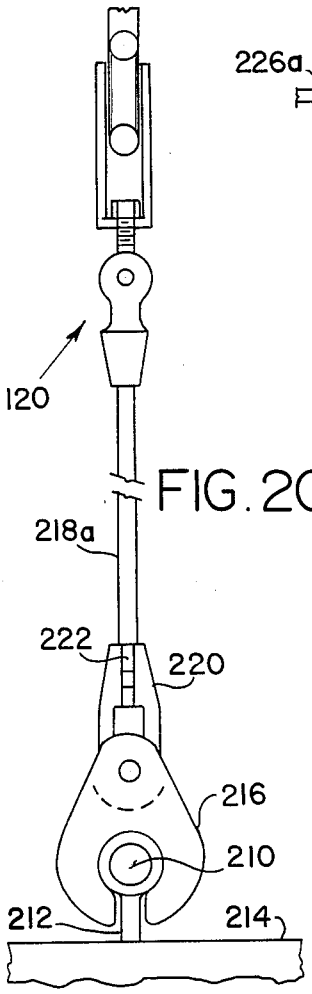

(a) the following discussing relates to the conditions with the loaded trolley disposed on the more demanding second outboard bridge portion (s), and to be representative of conditions with the trolley on the first outboard bridge portion;

(1) (FIG. 17, 18) a single length braided rope 192 (preferably nylon rope having exceptional elastic characteristics) has conventional thimble ends for shackle engagement to pins 194 with car 196 to fix the two ends of the one rope 192. (FIG. 17) From the car 196, located atop bridge 32 outer end portion with said second moored engagement (s), the rope segments 192*a,f* diagonally reach to sheaves 198, mounted atop the bridge to effect vertical rope segments 192*a,f* as a pair FIG. 18 to the port outboard side of towers 26 and spaced apart, maintaining said through-leg concept;

(2) the vertical rope segments 192*a,f* depend upon a pair of sheaves 200 to effect its "U" formation having said sheaves 200 spanned apart by spreader means 202. Midway between sheaves 200 the rope is contained by a clamp means 204 (FIG. 19) with extended bolt screw assembly 205. Screw means 206 is contained by brackets 208 fixed to spreader 202. Rotationally turning said screw means 206 disposes said clamp means 204 to one and from the other said sheave 200;

(b) FIG. 20*a,b* details the mode to engage antilist means 190 to a vessel, a repeating engagement effected with trade-off of LT 5. Longitudinally disposed pipe rail 210 is extended by serrated plate 212 by continuous weld to deck 214 and near the port side of the first vessel. A hook 216, arranged to engage at the pipe aft end for slideable fit along pipe 210, is connected by a stub wire length 218, having terminal socket ends 220, connected by means 120 to spreader 202.

Figure 20B:
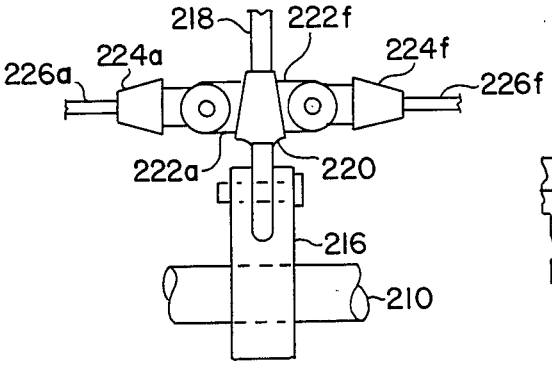

FIG. 20*b* Padeyes 222 welded as detailed, to socketed 220 end serve to pin connect socketed 224 ended wire 226 having its other wire end pear-lined to a post 228 fixed between the deck 30 and tower structure 26. A conventional counterweight means (not shown) with said post 228 is wire arranged for fastening to said pear link to keep wire 226 level as deck 214 changes elevation. Wire 226 serves to maintain pendants 192 vertical against the drag of hooks 216 over pipe rail 210 moving longitudinally (subsequently disclosed);

(c) car 196, conventionally guided, sliding atop bridge 32 for a thwartwise travel respective the vessel beneath, provides the anchorage control 230 of rope 192 system therewith. Monitored changing of car 196 distance toward or away from column assemblies (tower 26) correspondingly alters configuration of constant single length pendant assembly 192 equally for lengthened or shortened suspended pendant suiting vessel draft changes. Pendants are altered with trolley 22 disposed between towers 26, adapting mechanism of Ref B for said monitoring;

(1) baseplate 232 fixed atop bridge 32 provides for the mounting and bolted fix thereto of gear motor 234 powering drum means 236, as (drive) connected together by belt means 238. Multi-sheave head block 240 is also securely mounted to baseplate 232, while multi-sheave tail block 242 is fixed to car 196. Multiwrap storage capacity of wire rope 244 to drum 236 accomodates spacing apart of head and tail blocks 240,242 to comply with said suspended pendant length change required with draft variation of vessels.

A fore or aft move of crane 6 or an LT 5 occurs when trolley 22 is disposed between towers 26. Then, tension in pendants 192 is released to allow hooks 216 to tow freely along pipe rails 210 which extend to accommodate all cells; and, (2) the rope controlling means 230 comprising wire 244, multisheave blocks 240,242, drum 236, belt means 238 and motor 234, also is comprised of a conventional brake and lock means fitted with drum 236. The mode to adjust suspended lengths of pendant assemblies relies on said means to draw blocks 240,242 together thereby shortening said suspended length. A conventional brake means control the mass effect to lengthen said suspended length and conventional lock means fixes the adjusted said suspended length. Also not shown is a shear pin with the locking means (commonly understood to fail when overloaded) as a safety feature of said fixed pendants when floating vessels are subject to untoward forces by seas.

(3) Massiveness of vessels is pertinent to the disclosure of the antilist means, serving with the modulating means of the equalizer system, (contending with non-distributed loading of containers as stacked in guide fitted cells). Crane 6, sized to pass through the Panama Canal, in transit from building yards to its site, has a five foot freeboard when displacing 8700 lt. Thus the 48 lt trolley wheel load imperceptibly affects said freeboard.

The Lt 5 displacement is projected between 13,000 and 25,000 lt, depending on the traffic of a trade area. Celler 7, exceeding Panamax size, displaces some 100,000 lt. Lengthened synthetic ropes effecting the connection to a side of a vessel, and monitored to adjust with vessel draft change, provide suitable elastic stretch.

With the trolley upon said second outboard bridge portion, the moment thus developed is offset by the product of rope tension and lever arm approximately 55'. Such rope tension causes some list to the LT 5; and, inconsequential to the deposit of a container with Celler 7. The antilist means, serving repeating exchanges of vessels, effects useful integration of massive vessels as a balance means with the travel of a loaded trolley, and accommodates draft changes with exchange of containers. Concern about upsetting forces to the crane 6 is relied on a stabilizing system (subsequently disclosed).

(5) Hoisting means seen in FIG. 14 show container 38 having end section facing fore and aft as handled by the floating crane 6 and inferred so stowed in cells and on deck.

(a) Features and general arrangement (FIG. 14, 15).

Figure 15:
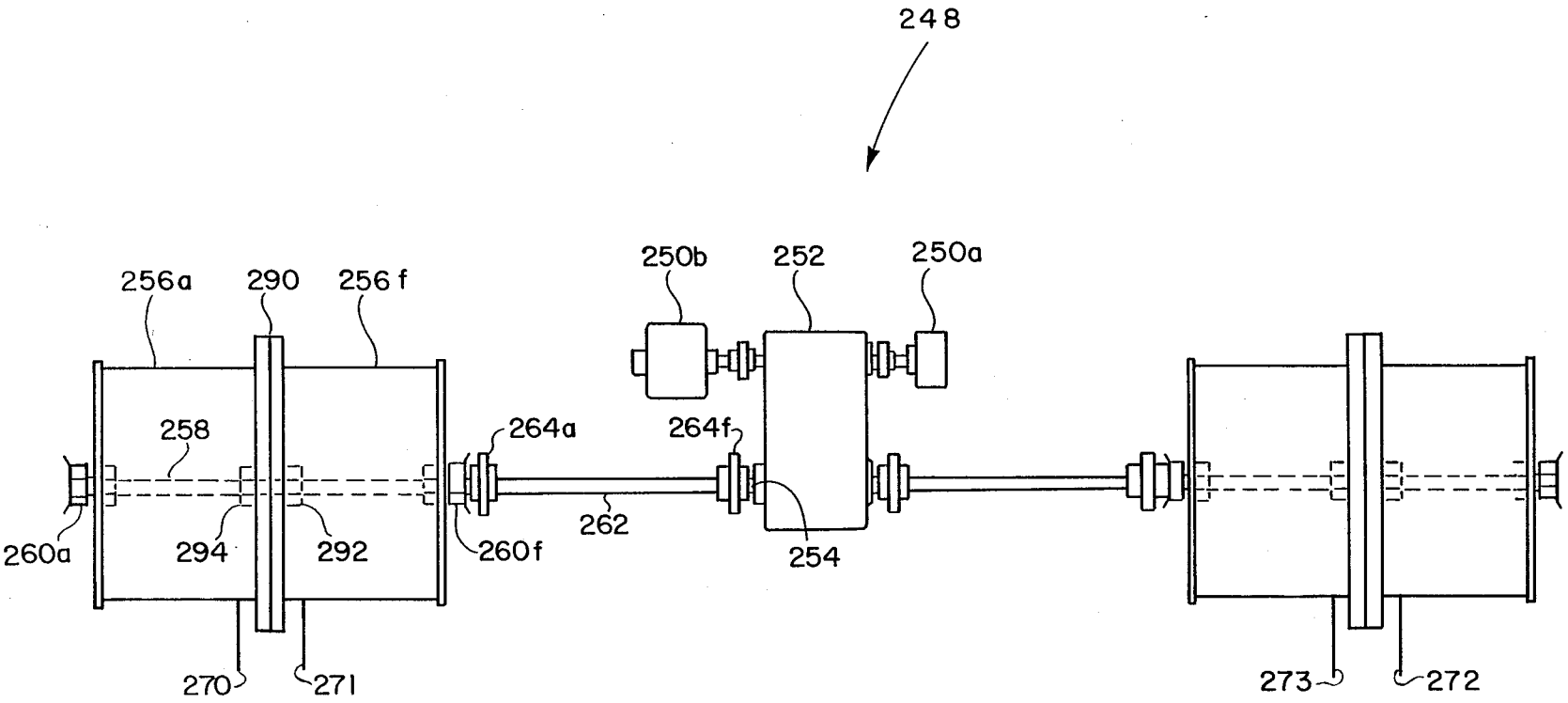

Drums 256 of FIG. 14 represents controlled hoisting power means 248 (shown in FIG. 15 as contained in house 48, and comprises: a brake 250*a*, a motor 250*b* connected to a centrally located gear unit 252 having double extended slow speed shafts 254, dual drums 256 (bolted together pairs) are supported by shaft 258 between two roller bearings 260 fixed to a baseplate. Like drum assemblies are spaced from gear unit 252 by extended floating shafts 262 with flexible couplings 264 as misalignment compensators between units. Drums, with single row wire wrap, are centered to respective double sheave head blocks 266 pivotally mounted to the underside of the trolley 22 (FIG. 14).

Single sheave tail blocks 268 are pivotally mounted to spreader frame 50 (the adjustable means remotely operated to engage with container 38, a separate classification). Tail block 268 centers are spaced apart about a sixth of head block 266 centers, to provide the angular setting needed for the horizontal component of half the dead weight to dampen swing caused with changed motion of trolley 22 (a conventional and preferred practice);

(b) Wire trace between their terminals, FIG. 14.

Four conventional socket fitted distal ended wires 270–273, off four drums 256 are separately reeved: through one sheave of each one's head blocks 266, down to single sheave tail blocks 268, up through the second sheave of head block 266, there towards bridge second outboard end 36, without reverse bending of wires, thus establishing four independent sets of blocks and falls as said traced with each pair of sets having blocks to a common plane, angularly suiting the spreader end section disposition, said sets being variously loaded commensurate with the non-distributing loading of containers;

(c) Dual equalizer systems.

Figure 10:
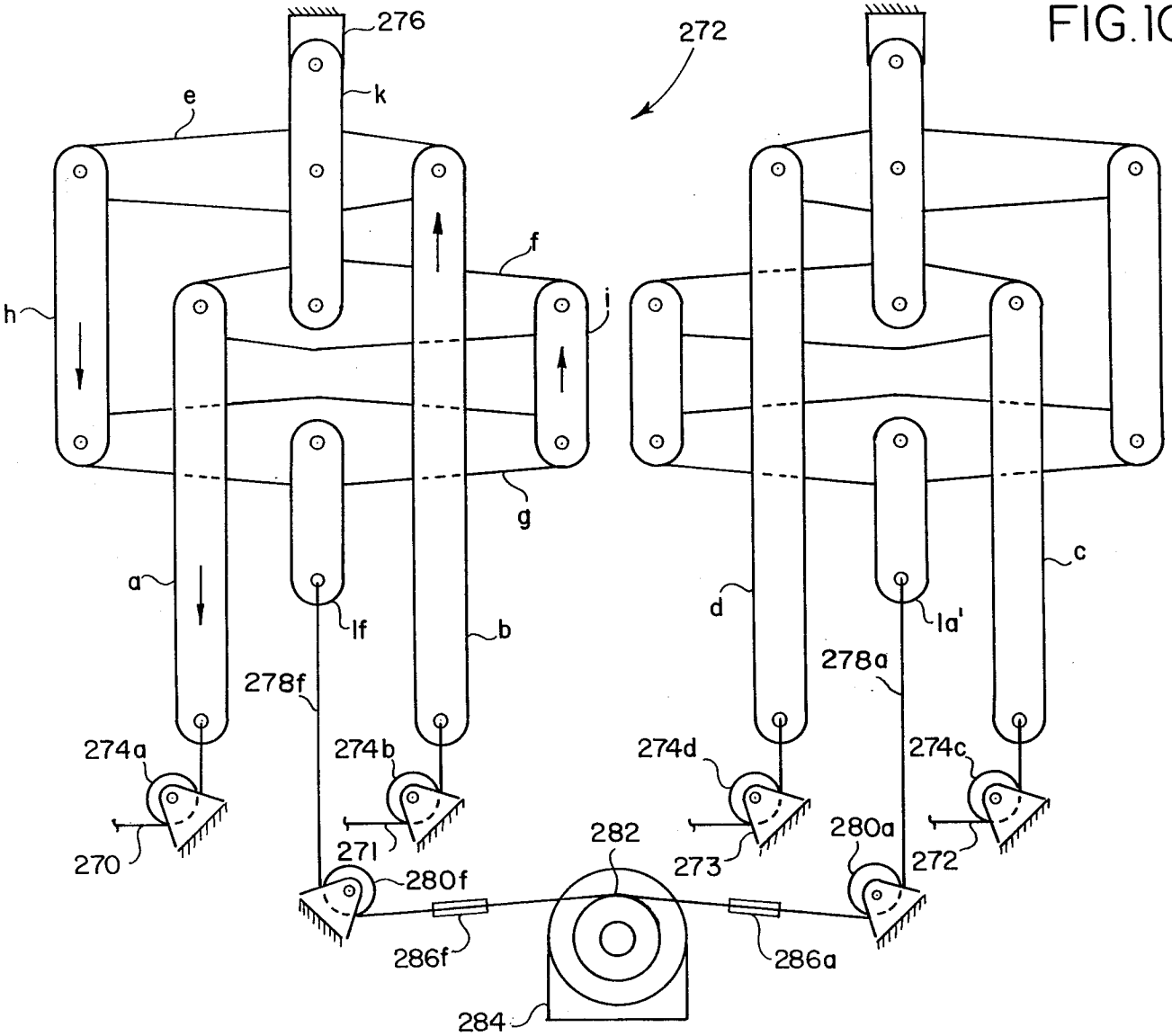

FIG. 10 discloses a combination of two equalizer systems 272 disposed as a vertical arrangement of links and levers at bridge end 36. However, sheaves 274 are shown (for better visualization) oriented 90° from true position, then to have its grooves aligned with lead of said four wires to be diverted upward for connection to links a–d by said socketed ends;

(1) each (duplicate) equalizer system is comprised of two alike levers e,f drilled for three pin connections. The intermediate pin serves as a fulcrum of the lever with end pins spaced one twice the distance from the fulcrum than the other (the shorter arm). Thus the notion of a 2:1 mechanical advantage. A lowermost third lever g has equidistantly spaced end pins from its fulcrum.

Links h–i connect ends of lever g to levers e,f. Intermediate links a–b serve to connect said socketed ended wires to a said shorter arm of lever e,f. All links, each of two bars, pin connect to thereby provide clearance for all levers disposed through a linkage;

(2) linkage k also for three pin mountings is suspended from upper pad eye 276, a bracket with bridge end 36*s*. Link k provides for the pivotal support of the levers e,f as fulcrums. Links l connects the fulcrum of levers g to a "third" wire 278, establishing the equalizer system of balancing three wires. In this case the "third" wire is the means to link two equalizer systems as one. Each equalizing system serving two wires; and as combined, four wires 270–273 are equalized together;

(3) sheaves 280 provide alignment of the two sided wire 278*a,f* oppositely wound off dual drum 282 under power by a self-locking worm gear and torque motor unit 284. Fractional turn of drum 282 by turns of motor 284 is monitored by a conventional level indicating instrument mounted to the spreader 50 for actuating with differences in end elevation (nonlevel container). Typically a mercoid switch (known to the art) at each end would serve to electrically monitor motor 284; and, (4) change in load in a wire with elastic stretch and minor differences with constructional stretch are modulated by the dual equalizer system. A trace of arrows, shown if FIG. 10, indicate the directional change to wires with tilt of levers. Elastic stretch of overloaded wire 271, taken as the upward directed arrow with link 'b', is automatically modulated with adjusting the pair of falls to proportionally share the non-distributed load. Wire 271 elongation with elastic stretch is sensibly shortened with link 'b' rise to CCW displace levers e,f. Commensurately, the sensible lengthening of wire 270, measured respective lever 'f' indicated by the downward directed arrow with link 'a', establishes tail blocks of the pair of sets to be horizontally disposed, variously loaded.

The description of the single equalizer in principle applies to the arrangement of FIG. 7 as a constituent of guy wire system having a structure (Sec B)g) disclosed.

(d) Hoist system adjustment:

(1) the hoisting wire system is adjusted at installation by means of turnbuckles 286 to establish equal spans and equal tension load in wires 270–273 with the system balanced level. Two wires 270,271 for one end of the trolley and spreader are made equal by a barring means to orient drilled flanges 290 bolting the dual drum 256 together. An alike adjustment is made for wires 272–273. (Note Fast couplings, gear type, provide vernier adjustment.);

(2) FIG. 25, said barring means depends on a through shaft 258 as supported by bearings 260. Inboard drums for wires 271,273 are constructed with keyed hubs 292 to the said through shaft 258; whereas the drums for wires 270,272 (outboard two) are constructed with bushed hubs 294 to freewheel said outboard drums when flanges 290 are not bolted together; and, (3) a temporary lever (said bar) suitably engages to a said outboard drum before flanges are completely unbolted. With said drum free wheeling the "barred" drum is rotated directionally to suit a wire adjustment by an arc of turn provided by the multiple hole drilled flange. With said flanges rebolted said bar serves the other dual drum.

Figure 16B:
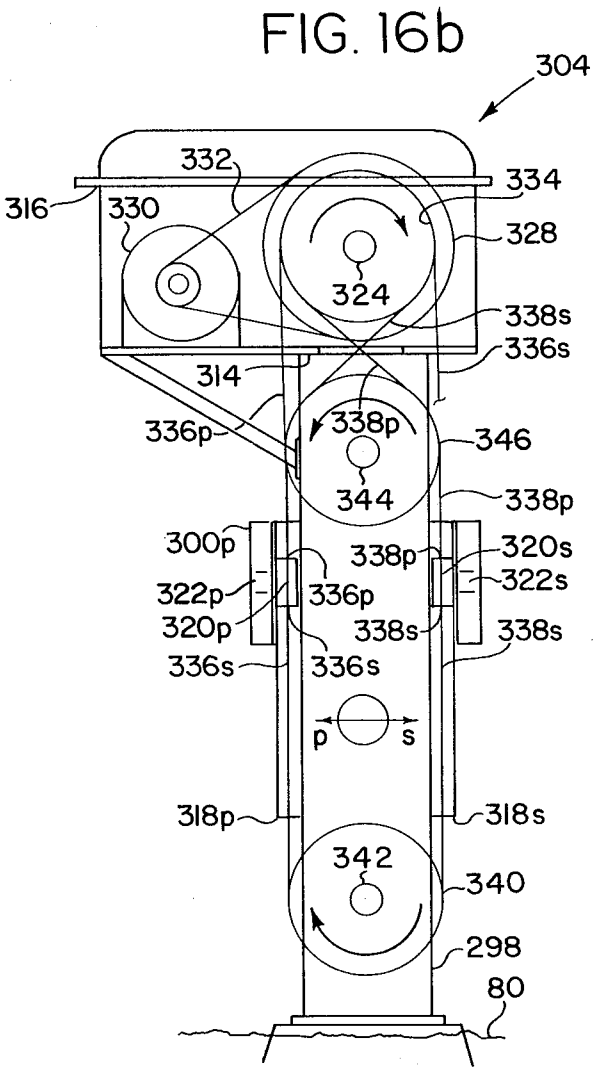
Figure 16C:
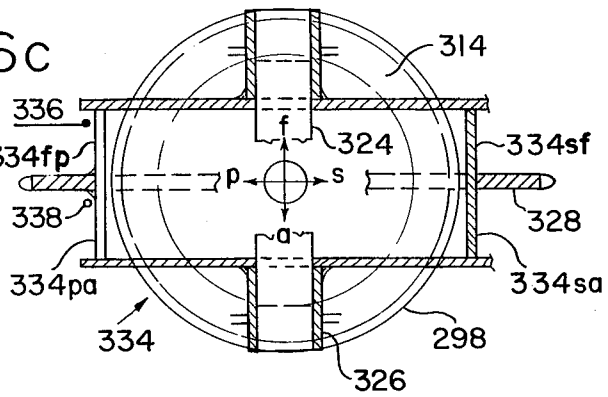
Figure 16A:
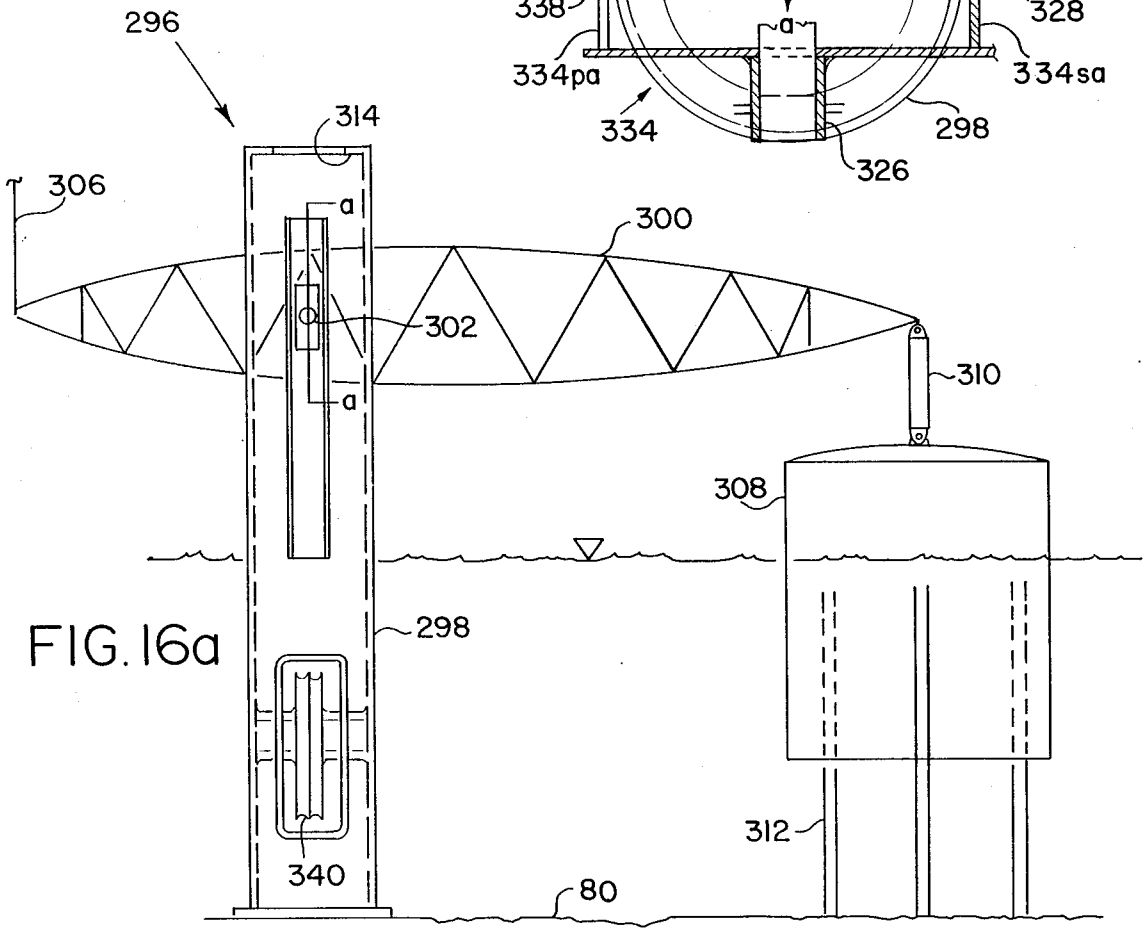
Figure 16D:
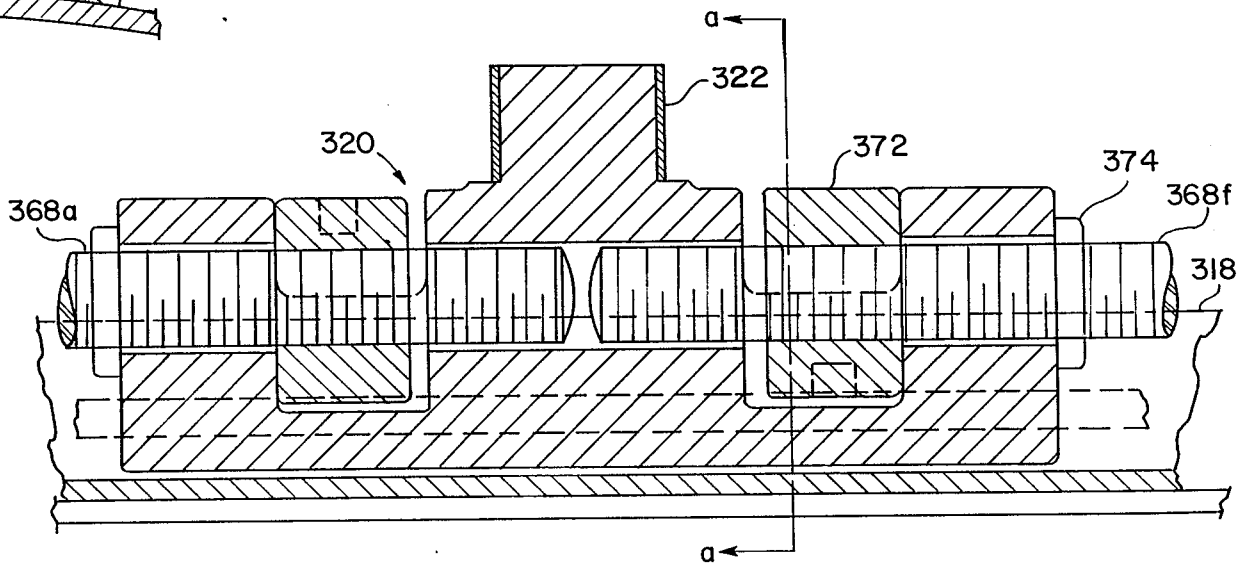
Figure 16E:
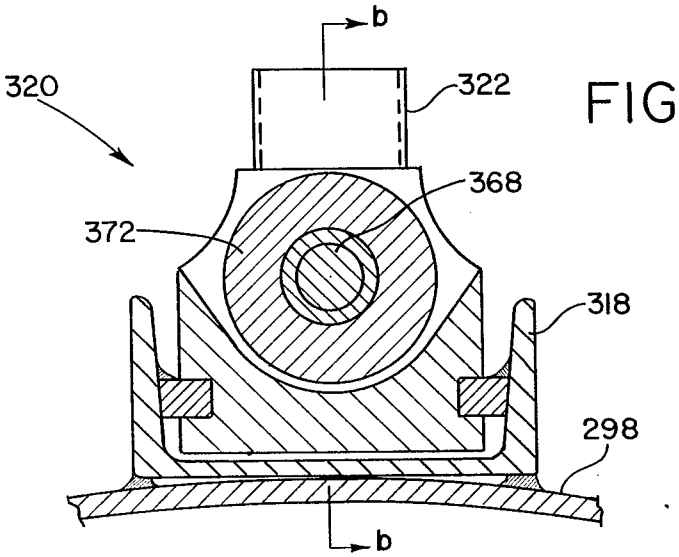

(6) Stabilzer means (FIGS. 1,4,16*a,b,c,d,e*).

(FIG. 16*a*) The stabilizing means 296 provides automatic monitoring of crane 6 when idle, particularly applicable in heavy weather affecting the stucture's exposure to winds. FIG. 1 shows idle crane 6*c* bridge portions with ends 34,36 connecting to stabilizing systems 296, with one disclosed in FIG. 16 comprised of: pipe 298, maintained erect by embedment with the seafloor 80, a truss type lever 300 having a fulcrum 302, a housed mechanism 304 (FIG. 16*b*) atop said pipe 298, and a float 308 linked 310 to lever 300;

(a) a steel wire pendant 306 imposing an upward pull to the shorter arm length of lever 300 is opposed by a float 308 connected by linkage means 310 to the longer (arm) length of lever 300;

(b) the following disclosure for stabilizer system 296*s* connected to bridge outer end 36*s* (is under stood typical also for stabilizer system 296*p* connected to bridge outer end 34*p*), comprises:

(1) stabilizer means 296*s* for the second outer bridge portion (with end 36*s*) comprises: a pendant 306 fixed, (reeled off a hand-operated winch means with brake, not shown), to said end 36, suspends with socketed end to pin connect with said shorter arm of lever 300 having an elevationally adjustable fulcrum 302 to cope with tidal change, and the longer arm of lever 300 having linkage 310 connects to float 308, contained to elevational motion only by pylons 312;

(2) (FIG. 16*a*) steel piping 298, with its center distantly established by said fulcrum 302 from vertical pendant 306, extends appeciably above extreme high tide. Internal ring flange 314 provides bolting means to fix house 316 (FIG. 16*b*) atop the pipe 298 to contain mechanisms; and, (3) (FIG. 16*b*) opposite external sides of pipe 298 have vertical guide means for slides 320 (FIG. 16*d,e*) having horizontally extending pins 322 effecting the fulcrum axis 302 for the lever 300. Lever 300 straddles pipe 298.

Slides 320 are contained by guide means 318, having had its pins 322 engaged with lever 300 prior to said straddling pipe 298, whereupon house 316 is mojnted with its contained mechanism;

(c) said house 316 contained mechanism comprising: a shaft 324, bearings 326, dual drum 334 having a centrally disposed sprocket 328, a chain drive 332, and gear motor 330 mounted to housing 316 (FIG. 16*b*). Dual drum assembly 334 (typically described) is bearing bush mounted to shaft 324 with sprocket 328 as the ring means effecting the dual drum concept. Drum 334 is larger than the diameter of pipe 298 for wire vertical extensions 336,338 off drums 334 to be centrally contained with slide means 320 so as to connect by screw adjusting means 120 (FIG. 22) to slides 320;

(1) disposed within pipe 298, to clear said water bed 80, is a pair of sheaves 340 bushing bearing mounted to shaft 342 fixed to pipe 298 (as disposed directly beneath and duplicating shaft 324 of FIG. 16*b*); and, diameters of sheaves 340 equaling the said diameter of drums 334. Disposed within said pipe 298 is a third shaft 344 between shafts 324,342 similarly mounted (FIG. 16*b*), having a pair of bearing bush mounted sheaves 346 in effect duplicating the lower assembly of sheaves 340;

(2) to disclose wire ropes 336,338 reeving with said sheaves, the orientation of members in FIG. 1 has been transposed to FIG. 16*c*, seen to have (f), (a), (p) and (s) designations assigned to respective members. Dual drum portions 334*f,a* sheaves 346*f,a* and lowermost sheaves 340*f,a* are aligned vertically;

(3) a directional arrow (CW) with drum 334 indicates a required raising of fulcrum 302 (pin 322). Wire ropes 336,338 each are of a single length with conventional socketed ends pin connected to an eye bolt (connection 120, FIG. 22). With suitable number of wraps to drum 334*f* and fixing thereto, wire pendant 336*f* has its uppermost end 336*p* said connected to slide 320*p* (FIG. 16*b*) and is hauled on to drum 334*f* for payout as wire 336*s* for a pendant extending to lowermost sheave 340*f* and reeving therewith, (having shunted sheaves 346 and slide 320*s*), its other end is connected 120 to the bottom of slide 320*p*. Wire 336 without reverse bending (possible without sheaves 346) raises fulcrum 320*p* with said CW rotated drum 334;

(4) to raise slide 320*s* (to the opposite side of pipe 298 with drum 344 rotated said CW) requires the use of sheaves 346 to effect a crossover of the single length wire 338 somewhat longer, otherwise identical to wire 336; and, (5) a trace of wire 338*p* diagonally up from sheave 346*a* for haul onto drum 334*a* also multiwrap fixed therewith, effecting a reverse wire bending, produces a payoff as 338*s* with diagonal approach to sheave 346*g* (available) for reeving as a vertical pendant down to sheave 340*a* (shunting slide 320*p*). From sheave 340*a* wire 338*s* by connection 120 joins to the bottom of slide 320*s*. The wire 338*s* other end connection (deferred to consider now) is connected 120 to the top os slide 320*s* thus raising fulcrum 302.

Figure 23:
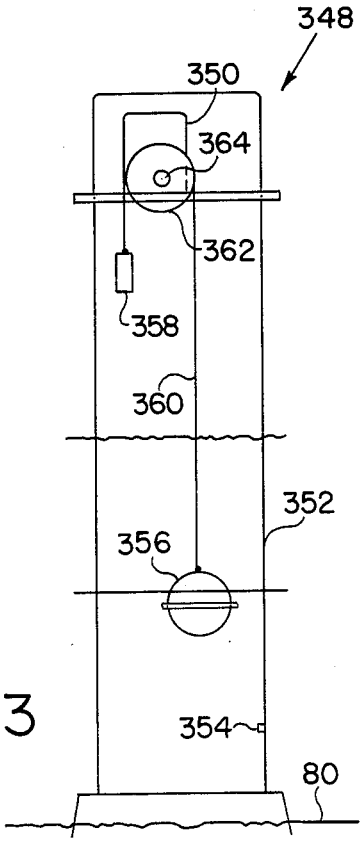

(7) Tidal monitoring means 348 (FIG. 23).

Selsyn devices (G.E. Co. CR 9890) serves the offshore terminal depending on certain sea floor embedments. A sender 340 (transmitter) is represented in FIG. 23 to serve various receivers associated with its motor to controlled turns, e.g. turns of sprocket 328 of FIG. 16*b;*

(a) transmitter 350 is mounted above highest tide in casing 352 secured to an embedment in sea floor 80. A small hole 354 in casing 352 affords dampened seawater circulation, avoiding surges, for the contained water level being a true reflection of the immediate tide level.

A float 356 disposed to said water level is connected to a counterweight 358 by a chain 360 looped over sprocket 362 key mounted to shaft 364 of transmitter 350; and (b) said water level changes alters the suspended length of chain connected to the float to turn sprocket 362 for electrical transmission to turn the receiver connected in the electrical circuitry for a motor.

(8) Miscellaneous.

Figure 18:
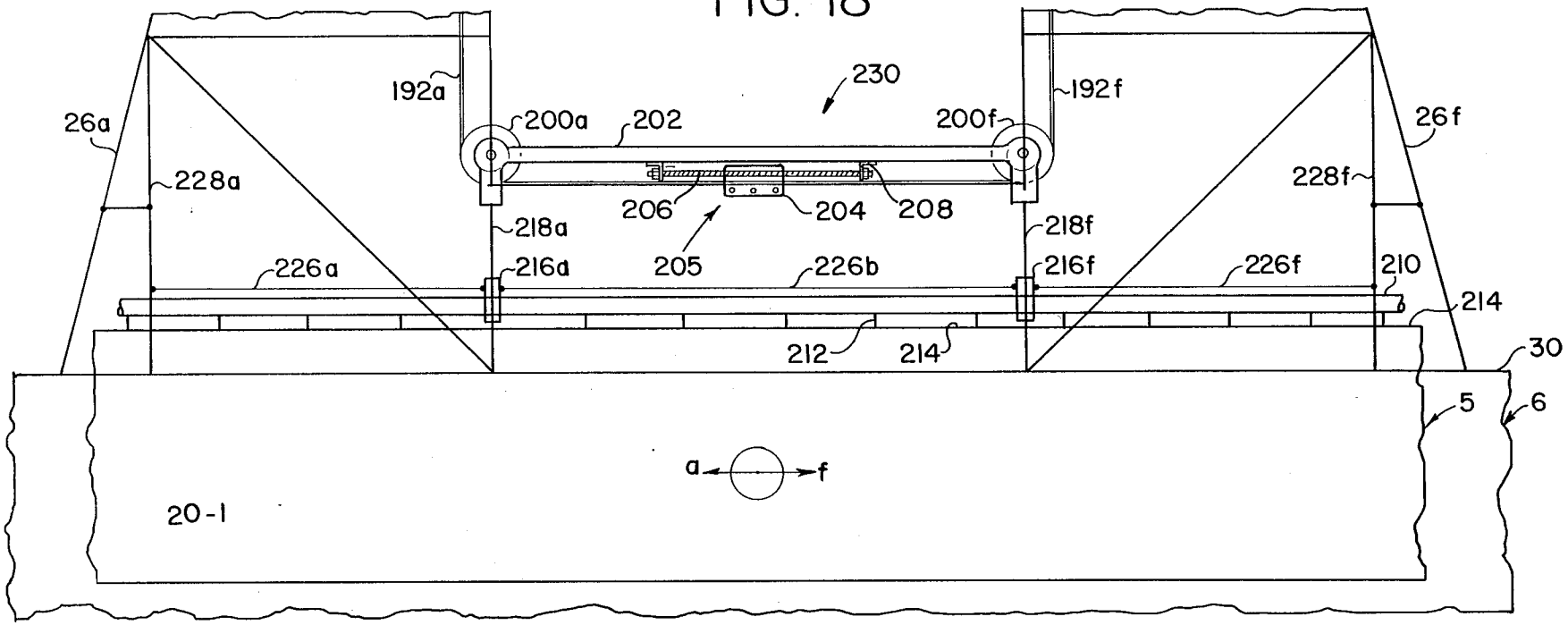
Figure 22:
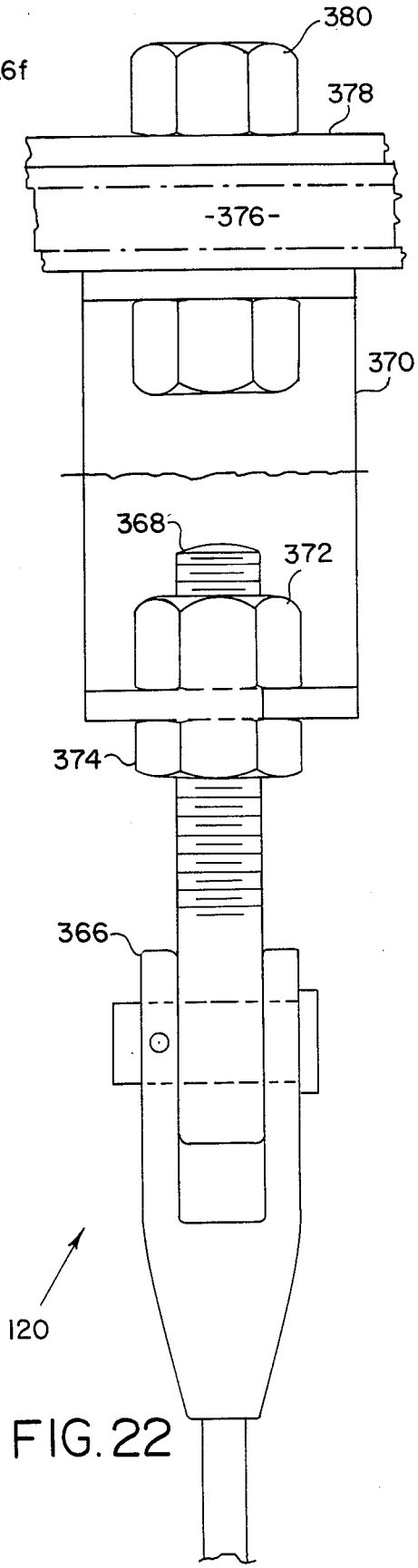

(a) FIG. 18. Often enough vessels do not trim level fore and aft by certain amounts; practically insignificant in the 42' span between hooks 216. To contend with whatever the difference, clamp means 205 provides the means to establish uniformly loaded rope pendants. Rotating screw 206 will make uneven pendant lengths from the normal; to elevate the sheave 200 bearing to the shorter pendant; thus raise that pendant 218 and lower the other, suiting the trim of the vessel;

(b) FIG. 22. Wire rope screw adjusting anchorage 120 comprises open end wire rope socket 366, eyebolts 368, adjusting nut 372, jamb nut 374, to selectively locate the wire terminal to bracket 370, which is representative of any practical more suitable means of anchorage; e.g., representative of body 370 for composite turnbuckle 184 of FIG. 13. As seen FIG. 22 bracket 370 may extend to bolt 380 to wall 376 of an FRP station 8,12,16, requiring backing plate 378;

(c) FIG. 13 composite turnbuckle 184 serves in the crane antiskew means. With the bridge 32 approximately thwartwise of the crane said straight course and wires 13,15 tensioned, turnbuckle 184 serves to vernier set the needed thwartwise orientation. Socket 366*s*, having a lug 382 to engage in slot 384 provided in nut 386 in engagement with bolt screw means 388 which is fixed laterally by clips 390 to station 8*s*,12, is repositioned by turning bolt screw 388 draws wires 13,15 interacting with sheaves 180 which are fixed to the bottom of crane hull 20;

(D) Precedents, establishing a commonly known double cantilevered, through-leg, floating (gantry) crane 6, are comprised of:

(1) a hull 20 with conventional ballast means;

(2) a suitable tower arrangement 26, said through-leg, having a base fixed to the deck 30 of said hull 20 and a top portion connected to the intermediate section of a through bridge 32, (said double cantilevered) thwartwise of said hull, with a (trackage) rails 42 extending between the first 34 and second 36 ends of the bridge 32;

(3) a moveable trolley 22, disposed on said rails 42, including a (vertically moveable and powered) hoist means 248 with a (container 38 engaging) spreader frame 50, serves for withdrawal and placement of containers;

(4) said cantilevered bridge having a second outer bridge portion extended above a second floating vessel 7 located alongside the crane 6 comprising a second moored engagement, and having a first outer bridge portion extending above a first floating vessel LT 5 along the other of the two-sided crane 6, comprising a first moored engagement;

the inprovement embodying: an offshore terminal existing in a sheltered cove, having limited embedded fenders for controlled straight course disposition of three floating vessel (5–7) in moored relationship, being uniformly unaffected by tidal range in said cove, and contending with control of four motion directional differences among said vessels having a first and second moored engagement means, comprising:

(a) holding the second vessel 7 stationary with fenders 4;

(b) a first 8*s* and second 12 distantly spaced apart primary floating stations, stayed to rise and fall with the tide, establishing limited connection of a wire system 10 having a motor drive towing means 96*s* for crane 6 disposition along a straight course to selected positions with the second vessel 7, in motion contention with said second moored engagement;

(c) a first 8*p* and second 16 distantly spaced apart secondary floating stations, stayed to rise and fall with the tide, establishing limited connection of a wire system 18 with motor drive towing means 96*p* for the LT 5 disposition along a straight course to selected positions with crane 6, including an integrating means of the LT 5 with said wire system 18 suiting the trade-off repetition effecting a first moored engagement;

(d) a wire system 28, with motor drive means, established between said bridge ends for a trolley 22 towing means effecting the trolley travel to selected thwartwise positions between said first 34 and second 36 bridge ends;

(e) a dual guy system 70 to provide additional support for said ends of bridge 32, including "A" frame 56 with apes 58 and wire means which connect the bridge outer end portions to the apes;

(f) a dual wire system 14 established and in tensioned arrangement between said primary floating stations, interacting wires with sheaves having mounting means to the bottom of said hull 20, with said wire being passive during said straight course unimpeded travel, and containing said wires with said sheaves to oppose impediments to travelling of said crane as an antiskew means to further comprise the first and second moored engagement;

(g) a dual wire system 52 established in tensioned arrangement between said bridge ends, interacting wires with sheaves having mounting means to the bottom of said trolley, with said wire being passive during said straight course unimpeded travel, and containing said wires to oppose impediments to travelling of said trolley for an antiskew means;

(h) a composite system of ropes with said vessels comprising:

(1) a second rope system 190*s*, having a motor driven mechanism 230*s* centrally disposed atop the second outer bridge portion, providing horizontal rope second portions 192*f,a* reeved to sheaves 198*f,a* for a pair of parallel selectively lengthened fixed pendants 192*pa*, 192*pf*, unencumbering to said through-leg for engaging means with said first vessel LT 5, still further comprising the first moored engagement; and, (2) a first rope system 190*p*, having a motor drive mechanism 230*p* centrally disposed atop the first outer bridge portion, providing horizontal rope first portions 192*f,a* reeved to sheaves 198*f,a* for a pair of parallel selected lengthened fixed first pendants 192*as*, 192*af* unencumbering to said through-legs for engaging means with said second vessel 7, still further comprising the second moored engagement;

(i) a stabilizing system for crane 6 comprising:

(1) a wire 306*s*, fixed to suspend from the second outer bridge portion, connects to the shorter arm of a second lever means 300*s*, having linkage 310*p* means 310*s* with a second float 308*s* and the fulcrum 302*s* of said lever having automatic elevational adjustment commensurate with tidal changes encountered at said terminals and the crane idle;

(2) a wire 306*p*, fixed to suspend from the first outer bridge portion, connects to the shorter arm of a first lever means 300*p* having linkage means with a first float 308*p* and the fulcrum 302*p* of said lever having automatic elevational adjustment commensurate with tidal changes encountered at said terminal; and, (3) said floats in lever arrangement with pendants stabilize the idle crane from being overturned by heavy weather.

(j) a hoist system 248, comprising four separate sets of blocks and falls, with each set variously tensioned (for elastic strech difference) commensurate with the non-distributed loading of a container 38, relies on a compositer of two equalizer means 272 for dead-end pin connection of their wires 270–273 single row wrapped off four drums 256. With a first pair of said sets connectedly associated with the container aft end for its two wires to said dead-end pin connect to two of three levers comprising the first equalizer and a second pair of said sets connectedly associated with the container forward end for its two wires to said dead-end pin connect to two of three levers comprising the second equalizer, and having said two levers linked to the third of said three levers with the third lever of the two equalizers connected together by a common wire 278 wrapped to a motor powered drum 282 to effect two leads to pay one lead off the drum commensurate with haul-on of the other (second) lead with fractional turn of the drum; whereby with monitoring of a non-level container (said non-distributed loaded) said composite equalizer system serves to modulate said stretch differences of falls for a level container.

(k) novelty of the trolley composite arrangement comprising:

(1) least weight imposed on trolley rails, having powered mechanisms for trolley tow and hoist means disposed as counterwieght means to offset unequal length outer bridge portions;

(2) automatically established level tail block position, having a composite equalizer system modulating elastic stretch differences of four falls bearing a container non-distributed loaded;

(3) dampens swing of a load with change in trolley motion; and, (4) single tier winding of wires on drums, limiting fleet angle to a half degree, and avoids reverse wire bending.

What is claimed is:

1. In a combination having a commonly known double cantilevered, through-leg, floating gantry crane comprising, a hull and deck contained tower means, disposing a bridge elevationally above said deck for a trolley with hoist means towed between bridge ends to exchange containers as an arrangement of three floating vessels, unencumbered by tidal change, with said crane having a second outer bridge portion extending above a fixed positioned second floating vessel located alongside the crane for a second moored engagement, and having a first outer bridge portion above a moveable first floating vessel along the other of the two sided crane for a first moored engagement;

for a development embodying an offshore terminal in a sheltered cove for disposition of said three floating vessels in contention with control of four motion directional differences among said vessels involving said moored engagement, the improvement comprising:

(a) a first and second distantly spaced apart primary floating stations, stayed to rise and fall with the tide, establishing limited connection of a motor powered wire towing system for said floating crane disposed along a straight course to selected positions with the second vessel in motion control with said second moored engagement;

(b) a first and second distantly spaced apart secondary floating stations, stayed to rise and fall with the tide, establishing limited connection of a motor powered wire towing system for said first floating vessel disposed along a straight course to selected positions with the crane, including an integrating means of the first vessel with its wire system suiting the repeating trade-off of first vessels effecting a first moored engagement;

(c) dual spaced apart 'A' frames mounted atop the bridge portion contained between said towers, having a simple connecting truss spanning between apices of said 'A' frames, providing for the upper connection of a guy system extending for connection to bridge ends;

(d) a dual wire system established in tensioned arrangement between said primary floating stations, interacting said wires with sheaves having mounting means to the bottom of said crane hull, with wires being passive during said straight course unimpeded travel and containing said wires with sheaves to oppose impediments to travelling of said crane as a crane antiskew means furthering the first and second moored engagement;

(e) a second antilist rope system having a motor drive mechanism atop said second outer bridge portion for a rope arrangement with sheave means for tension engagement to the first floating vessel, and a first antilist rope system having a motor drive mechanism atop said first outer bridge portion for a rope arrangement with sheave means for tension engagement to said second floating vessels, said rope systems accommodating disposition of the trolley over said outboard bridge portions and variation in draft of vessels with container exchanges;

(f) a stabilizing means including a second lever having a fulcrum automatically contained to constant clearance above tidal water level, depending on the second lever longer arm connection to a second float providing buoyant reaction to the tension in a pendant connecting said second lever shorter arm to said second outer bridge portion, and a first lever having fulcrum automatically contained to constant clearance above tidal water level, depending on the first lever longer arm connection with a first float providing buoyant reaction to the tension in a pendant connecting said first lever shorter arm to said first outer bridge portion, said floats stabilizing the idle crane in heavy weather; and, (g) a composite equalizer arrangement modulating elastic stretch differences in a four wire hoisting system bearing a container non-distributedly loaded.

* * * * *